US011814930B2

(12) United States Patent
Wright et al.

(10) Patent No.: US 11,814,930 B2
(45) Date of Patent: Nov. 14, 2023

(54) WASH TOOL

(71) Applicants: Wright's Well Control Services, LLC, Spring, TX (US); David C. Wright, Spring, TX (US); John W. Angers, Jr., Broussard, LA (US)

(72) Inventors: David C. Wright, Spring, TX (US); John W. Angers, Jr., Broussard, LA (US)

(73) Assignee: WRIGHT'S IP HOLDINGS, LLC, Magnolia, TX (US)

( * ) Notice: Subject to any disclaimer, the term of this patent is extended or adjusted under 35 U.S.C. 154(b) by 0 days.

(21) Appl. No.: 17/802,037

(22) PCT Filed: Feb. 25, 2021

(86) PCT No.: PCT/US2021/019705
§ 371 (c)(1),
(2) Date: Aug. 24, 2022

(87) PCT Pub. No.: WO2021/173857
PCT Pub. Date: Sep. 2, 2021

(65) Prior Publication Data

US 2023/0088389 A1 Mar. 23, 2023

Related U.S. Application Data

(60) Provisional application No. 63/152,167, filed on Feb. 22, 2021, provisional application No. 63/042,804,
(Continued)

(51) Int. Cl.
*E21B 23/02* (2006.01)
*E21B 37/04* (2006.01)
(Continued)

(52) U.S. Cl.
CPC ..... *E21B 37/04* (2013.01); *E21B 23/02* (2013.01); *E21B 33/129* (2013.01); *E21B 37/08* (2013.01); *E21B 41/0078* (2013.01)

(58) Field of Classification Search
CPC ..... E21B 23/02; E21B 33/124; E21B 33/129; E21B 37/04; E21B 37/08; E21B 41/0078
See application file for complete search history.

(56) References Cited

U.S. PATENT DOCUMENTS 5,269,374 A 12/1993 Taylor
5,318,119 A 6/1994 Lowry et al.
(Continued)

FOREIGN PATENT DOCUMENTS

CN 213116212 U * 5/2021
WO WO-2021173857 A1 * 9/2021

*Primary Examiner* — Daniel P Stephenson
(74) *Attorney, Agent, or Firm* — McCutcheon Joseph, PLLC

(57) ABSTRACT

A wash tool comprises a mandrel with a central annulus and one or more lateral bores and one or more ring-shaped rotary hubs positioned about the mandrel adjacent to the one or more lateral bores. The rotary hubs comprise lateral bores perpendicular to the lateral bores of the mandrel such that pressurized fluid introduced to the central annulus of the mandrel impacts the inner surface of the rotary hubs and forces them to rotate, delivering pressurized fluid to the inner surface of a wellbore or tubular. The wash tool is modular and can be attached to a top sub or bottom sub, and may be used with or without a wireline. When used with a wireline, the wireline is insulated from the wash fluid by means of a tie-back and multiple seals.

17 Claims, 20 Drawing Sheets

Related U.S. Application Data filed on Jun. 23, 2020, provisional application No. 62/981,312, filed on Feb. 25, 2020.

(51) Int. Cl.

| | |
|---|---|
| *E21B 33/129* | (2006.01) |
| *E21B 37/08* | (2006.01) |
| *E21B 41/00* | (2006.01) |

(56) References Cited

U.S. PATENT DOCUMENTS

| | | | | |
|---|---|---|---|---|
| 5,355,956 | A | 10/1994 | Restarick | |
| 5,377,750 | A | 1/1995 | Arterbury et al. | |
| 6,189,618 | B1 * | 2/2001 | Beeman | E21B 34/14 166/194 |
| 8,590,616 | B1 | 11/2013 | McClinton et al. | |
| 9,624,757 | B2 * | 4/2017 | Telfer | E21B 37/02 |
| 10,041,317 | B1 * | 8/2018 | Swinford | E21B 34/12 |
| 2019/0169961 | A1 * | 6/2019 | Dennis | E21B 37/06 |
| 2022/0106859 | A1 * | 4/2022 | Lund | E21B 37/04 |
| 2023/0088389 | A1 * | 3/2023 | Wright | E21B 23/02 |

* cited by examiner

200

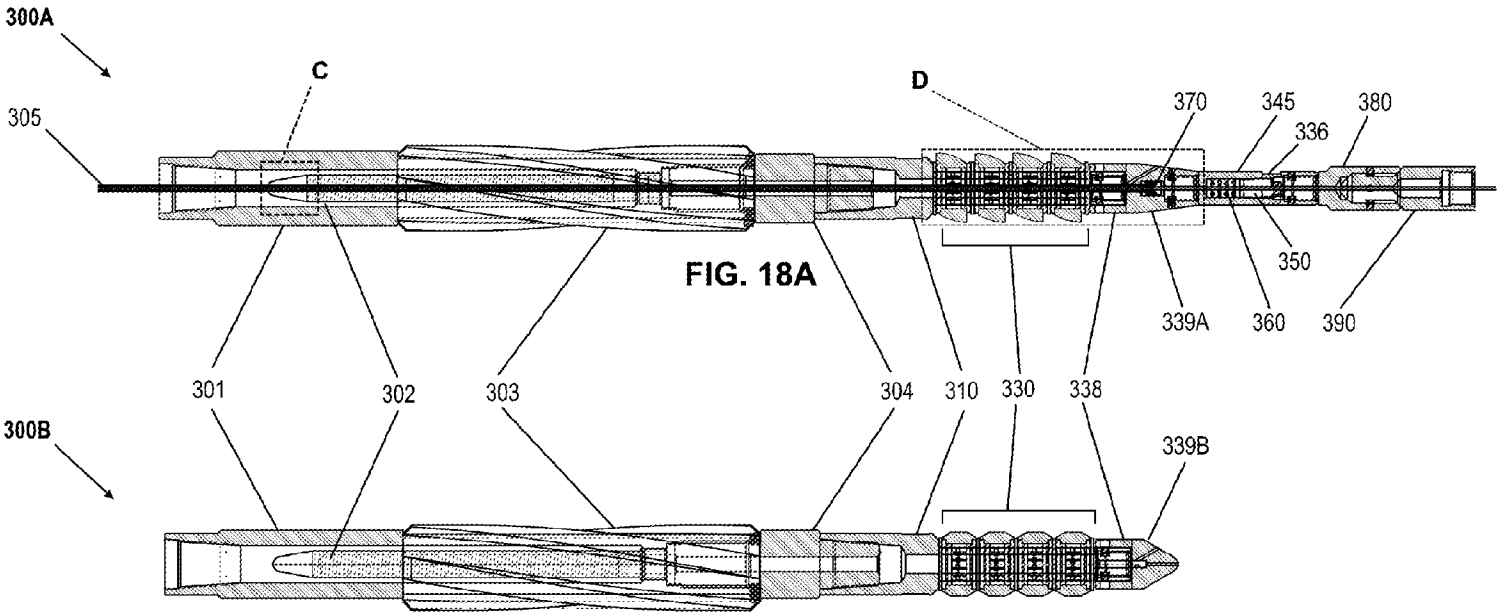
FIG. 18A
FIG. 18B
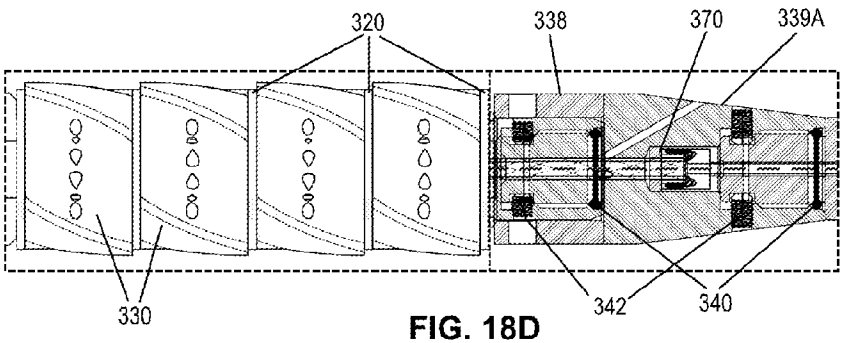
FIG. 18D
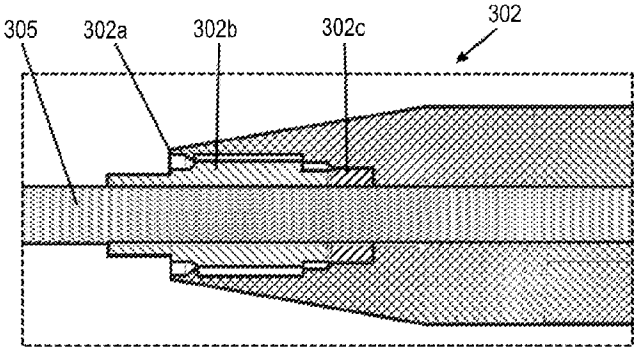
FIG. 18C

WASH TOOL

REFERENCE TO RELATED APPLICATIONS

This is a United States utility patent application claiming priority to co-pending Patent Cooperation Treaty (PCT) application No. PCT/US21/19705, filed 25 Feb. 2021, which in turn claimed priority to U.S. Provisional Application Nos. 62/981,312, filed 25 Feb. 2020, 63/042,804, filed 23 Jun. 2020, and 63/152,167, filed 22 Feb. 2021, all having the same title of "Wash Tool." The contents of the PCT application and three above-named provisional applications are incorporated in their entireties herein by reference.

FIELD

The application relates generally to a wash tool apparatus particularly usable for cleaning, clearing and abrading an annulus via pipe connection, coil tubing, electric coil tubing (e-coil), electric-line (e-line) or slick-line (s-line), where the wash tool apparatus prevents liquid from the wash tool from interfering with the conduction and operation of the c-line. The tool can attach to and interface with other e-line tools or electronics for logging, structural measurement, as well as s-line tools for pulling valves, setting plugs, shifting sleeves, gas lift work and other tool functions.

BACKGROUND

In coal & gas production, it is increasingly common to utilize conductive, electronic wireline in tubulars, piping, flowlines, and production lines to enable the use of electronic sensors and electronically actuated tools downhole. One such common class of tool is a "wash tool," which sprays high-pressure water or cleaning fluid to clear out particulates and light obstructions in a wellbore.

However, these wash tools are often not suitable for use with e-line tool strings due to the potential for electrical interference. While e-line/e-coil cables themselves are well-protected from the elements due to their uses in downhole exploration and production, the connection points between the cable and the electronic sensor or tool are often more fragile and vulnerable.

A need therefore exists for a wash tool that can be fluidly isolated from the e-line/e-coil and usable for more easy compatibility with electronic sensors and electronically actuated tools. Embodiments disclosed in the present application meet this need.

SUMMARY

In an embodiment, the invention may comprise a mandrel, the mandrel comprising a longitudinal axis, a central annulus along the longitudinal axis, and a plurality of lateral bores extending from an outer surface of the mandrel through the mandrel to the central annulus. One or more rotary hubs may be mounted about the outer surface of the mandrel, and each rotary hub can comprise a plurality of lateral bores extending therethrough. One or more bushings can be distributed about the outer surface of the mandrel, sandwiching each rotary hub of the one or more rotary hubs. The bushings permit the one or more rotary hubs to rotate freely about the longitudinal axis of the mandrel. The lateral bores of the rotary hubs may be angled perpendicular to the lateral bores of the mandrel, wherein fluid flowing from the central annulus, through the lateral bores of the mandrel, impacts the plurality of lateral bores of each rotary hub, causing them to rotate about the longitudinal axis and disperse the fluid outwardly into the tubular or wellbore.

In an embodiment, the invention may comprise a wireline extending through the central annulus of the mandrel. The wireline can be insulated from the fluid by a tie-back comprising a male member and a female member, wherein the male member can be concentric to the wireline and the female member can be concentric to the male member and can brace against a sealing sub. The fluid is further sealed by a plurality of seals located within a central annulus of the sealing sub and concentric to the wireline, wherein an upper end of the sealing sub can be attached to a lower end of the mandrel. A packing gland may be located within the central annulus of the sealing sub and also concentric to the wireline, abutting the plurality of seals. The packing gland may comprise a threaded portion, a wrench head portion, and an orifice for the wireline, while the sealing sub can comprise internal threads interfacing with the threaded portion of the packing gland and an access window positioned concentric to the wrench head portion of the packing gland for selective manipulation of the packing gland. A lower crossover member may attach to a lower end of the sealing sub, and a bottom socket may attach to a lower end of the lower crossover member, wherein the lower crossover member and the bottom socket can comprise a central annulus concentric to the wireline, and wherein the bottom socket can accommodate additional tools to be controlled by the wireline.

In an embodiment, the lateral bores of the mandrel may comprise a first angle and a second angle, wherein the second angle is shallower relative to the first angle to produce an elbow shaped bore, causing the fluid to exit the central annulus of the mandrel at the first angle and exit the lateral bore of the mandrel at the second angle. The plurality of lateral bores of the mandrel may comprise alternating orientations, such that adjacent lateral bores or the plurality of lateral bores cause adjacent rotary hubs to spin in opposite directions. The rotary hubs may comprise inner surfaces, wherein the inner surfaces can comprise semi-circular voids, and wherein the impact of the fluid on the inner surfaces one or more rotary hubs causes rotation. The rotary hubs may further comprise a pair of carbide inserts for smoother rotation. The rotary hubs may further comprise a plurality of brush bristles for scraping the inner surface of the tubular or wellbore.

In an embodiment, the mandrel may be secured to a nose cone at the lower end, which may be either standalone or the means by which the sealing sub attaches. The nose cone may comprise a central annulus and a plurality of lateral bores perpendicular to the central annulus, wherein the lower end of the nose cone is obstructed (e.g., either by a blunt surface or the tie-back and seals of the sealing sub) to force any remaining fluid out of the lateral bores of the nose cone.

In an embodiment, the mandrel may be secured to a top sub at the upper end, by means of an upper crossover, and the top sub and upper crossover can comprise a central annulus. The central annulus of the top sub may house an elongate pin screen filter, wherein a lower end of the pin screen filter can be braced against an inner shoulder of the top sub by the upper crossover, and wherein the pin screen filter can extend into the central annulus of the top sub and can filter the fluid prior to entering the mandrel. For wireline embodiments, the pin screen filter may comprise a central annulus and a flared socket located at an upper end of the pin screen filter, wherein the flared socket houses a packing gland and a seal between the packing gland and the central annulus, and wherein the packing gland, seal, and pin screen filter are all concentric to a wireline. The top sub may further comprise a centralizer sleeve about the top sub, wherein the centralizer sleeve can be braced against an outer shoulder of the top sub by the upper crossover, and wherein the centralizer can comprise a plurality of ribs for centralizing the tool within the tubular wellbore.

In an embodiment, the mandrel may comprise a plurality of inlet ports at an upper end, a first sealing cup facing upwards and positioned about the outer surface of the mandrel below the plurality of inlet ports, and a second sealing cup facing downward and positioned about the outer surface of the mandrel below the first sealing up and above the one or more rotary hubs. The first sealing cup can direct fluid inwardly through the plurality of inlet ports into the central annulus of the mandrel, and the second sealing cup can prevent flowback of fluid ejected from the lateral bores of the one or more rotary hubs.

DRAWINGS

FIGS. 18A-18D depict wired and wireless embodiments of the wash tool with top sub and bottom sub (for wired).

The detailed description below is described with reference to the above drawings.

DESCRIPTION

Before describing selected embodiments of the present disclosure in detail, it is to be understood that the present invention is not limited to the particular embodiments described herein. The disclosure and description herein is illustrative and explanatory of one or more presently preferred embodiments and variations thereof and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Figure 1A:
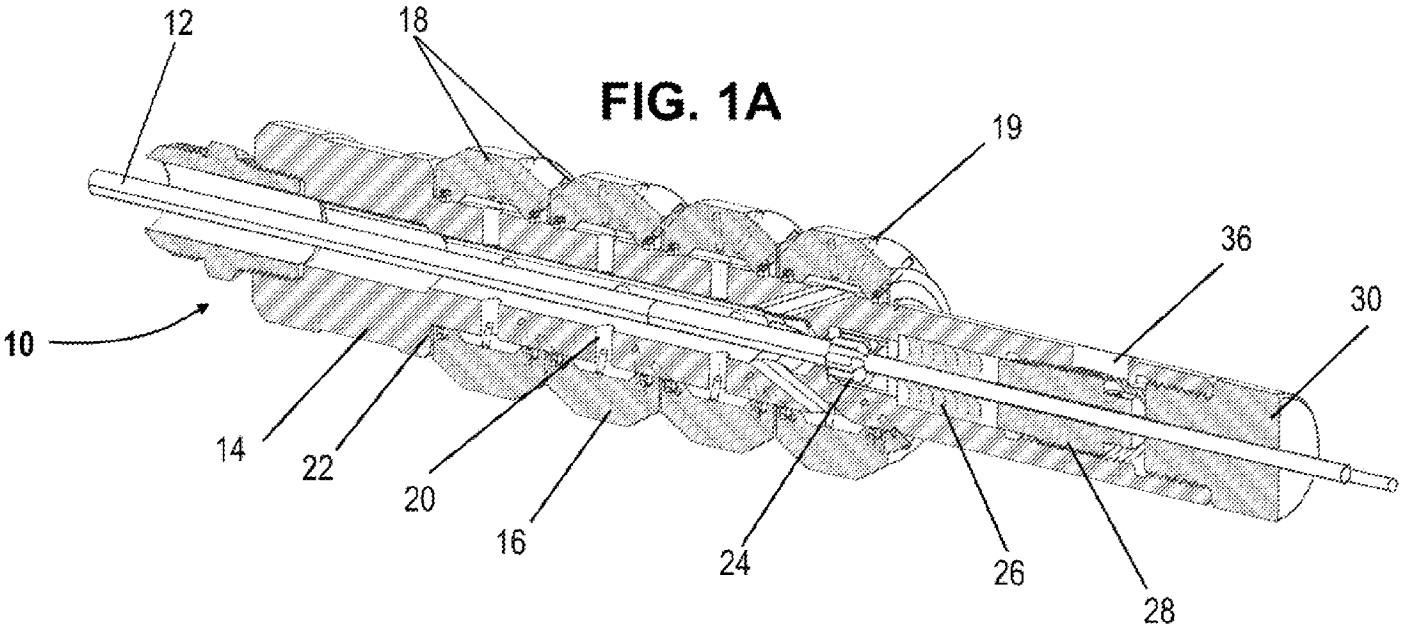
FIGS. 1A-1B depict a cross-section perspective and side view of an embodiment of the wash tool.
Figure 1B:
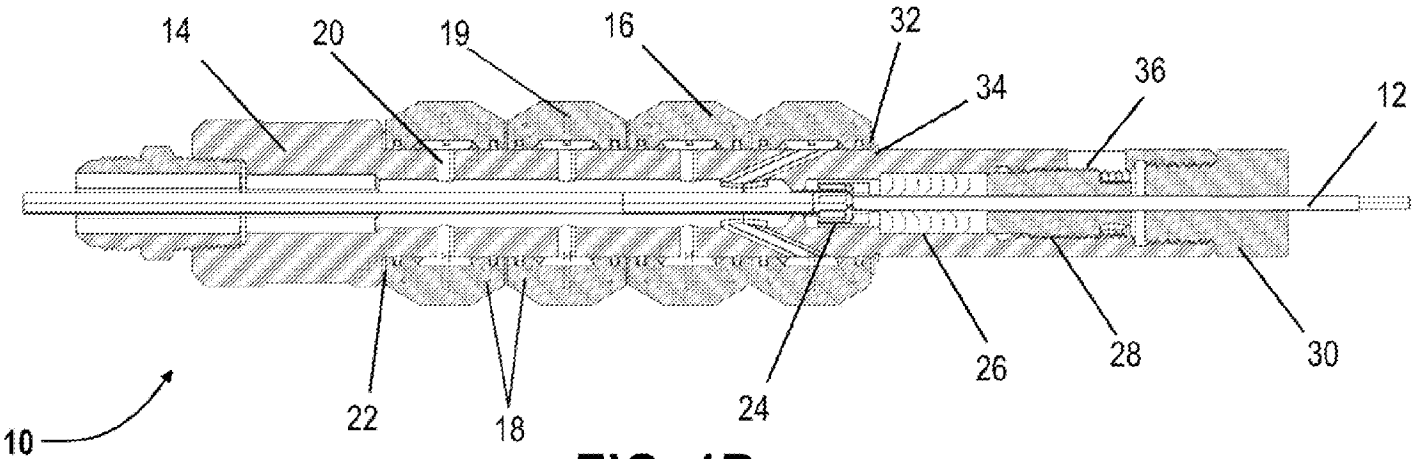

Turning now to FIGS. 1A-1B, two cross-sections of an embodiment of the wash tool 10 are depicted in perspective and side views. Wash tool 10 is shown based around a mandrel 14 with a central annulus, which can be run along an e-line (or e-coil or e-slickline, etc.) cable 12 that can extend through the central annulus on a longitudinal axis and be affixed with a threaded top sub (depicted later). A plurality of rotary hubs 16 can be mounted on the outer surface of mandrel 14, in such a way as to be capable of rotating around the mandrel and the longitudinal axis of the central annulus and e-line cable 12. Each rotary hub 16 can comprise a plurality of lateral bores 18, 19 that can be distributed at varying angles (offset perpendicular or 90 degrees perpendicular) along the circumference of the tool. The central lateral bores 19, which can be located in the center of the rotary hub 16, can act as drive ports, i.e., the washing fluid circulating through them can exert a jet force to drive the rotation of the rotary hubs 16. Each rotary hub 16 can be mounted on at least one rotary seal 22, in a position corresponding to a flow path 20 through the mandrel 14, which can fluidly connect the interior of the rotary hubs 16 with the annulus surrounding the e-line cable 12. Wash fluid can then flow down the annulus around the e-line cable 12, into one of the plurality of flow paths 20, where it can be directed through one of the plurality of lateral bores 18, 19.

After the final flow path 20, the annulus around the e-line cable 12 terminates, while the e-line cable 12 can continue through a tie-back 24, a v-packing seal 26, a packing gland 28 and/or a connecting sub 30. The tie-back 24 secures the portion of the e-line cable 12 within the mandrel 14 using a non-conductive metal, polymer, or any suitable insulating material. Tie-back 24 can also keep the tool in vertical position on the e-line cable 12, while the gland 28 can tighten the mandrel 14 around the cable. Seals 26 (e.g., the v-packing seals) can further prevent wash fluid from going past the wash tool 10. An access window or plurality of access windows 36 can be located on the mandrel 14, and the access window(s) 36 can permit access to the packing gland 28 so the tool can be loosened or tightened onto a slickline. Additionally, the mandrel 14 can comprise a bearing plate 32 and retainer ring 34 for preventing vertical movement of the rotary hubs 16 during operation.

Figure 2B:
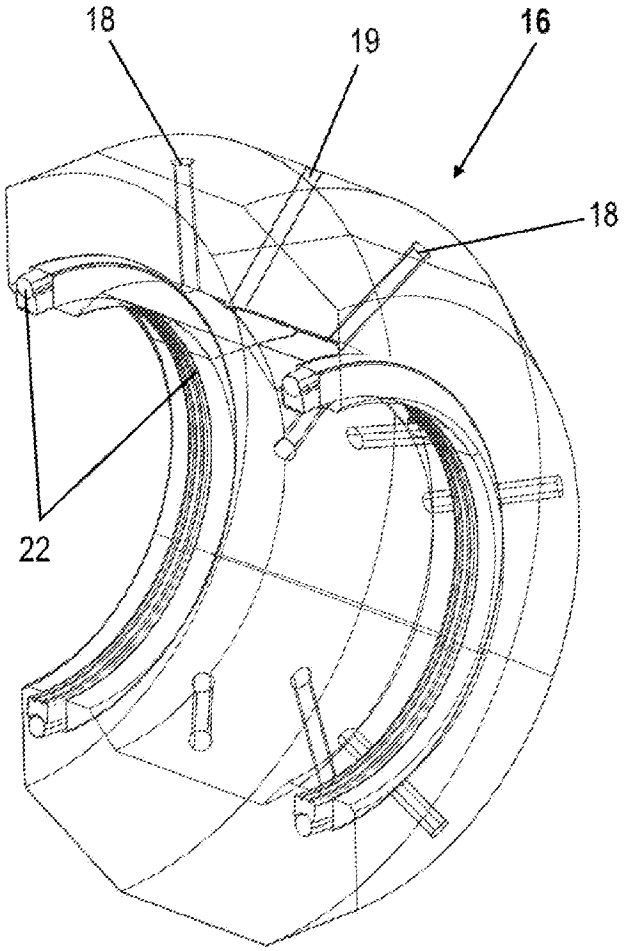
FIGS. 2A-2B depict cutaway and perspective views of an embodiment of the rotary hub component of the wash tool.
Figure 2A:
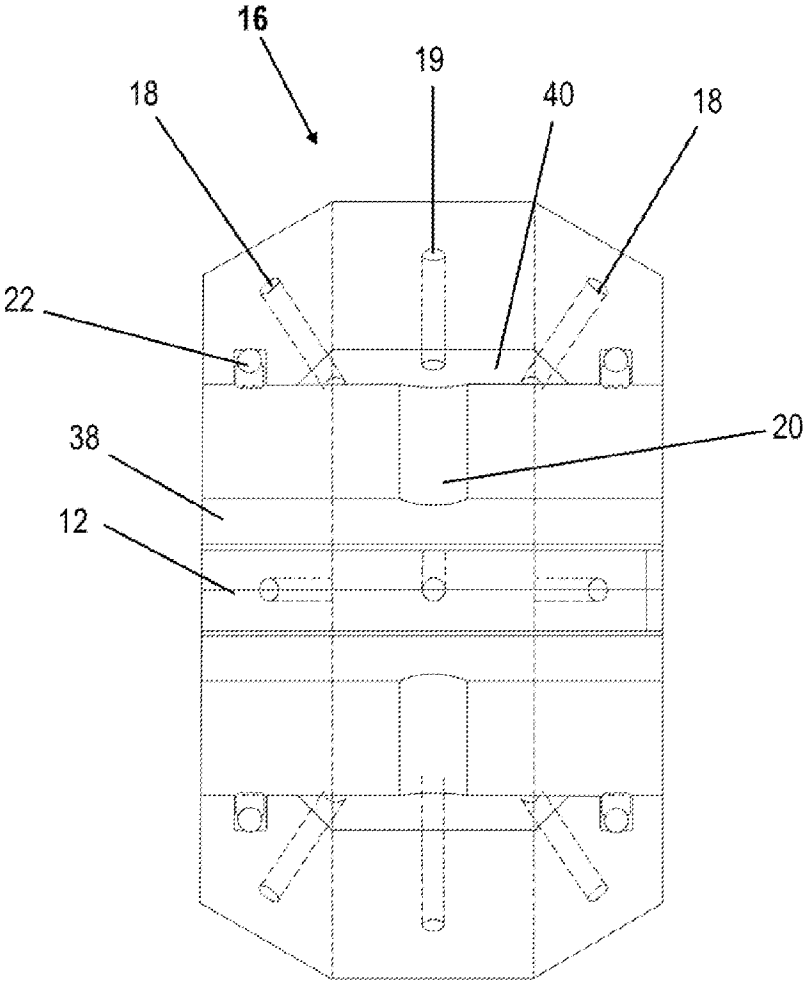

Turning now to FIG. 2A-2B, two detailed views of an embodiment of a rotary hub 16 are shown in further detail. As shown, wash fluid can flow down the annulus 38 surrounding e-line cable 12, through flow paths 20 and into a fluid distribution cavity 40. From there, the wash fluid may exit through one of the offset lateral bores 18 or one of the central lateral bores 19. (While each rotary hub 16 is shown with at least three pairs of offset lateral bores 18 and three central lateral bores 19, only one set is labeled for clarity). FIG. 2B shows the relative angles of the offset lateral bores 18 and the central lateral bore 19. In an embodiment, the rotary hubs 16 can be stacked onto the mandrel 14 in such a way that alternating rotary hubs 16 can be oriented to be driven in opposite rotational directions by central lateral bore 19. FIG. 2B also shows clearly the full circumference of the rotary seals 22.

Figure 3B:
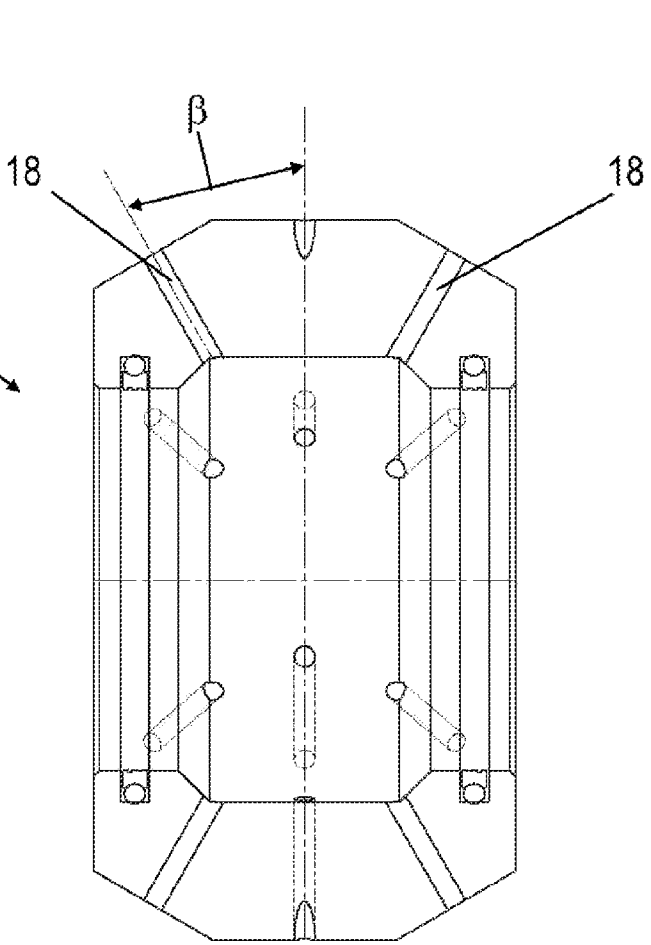
FIGS. 3A-3B depict top and side views of an embodiment of the rotary hub component of the wash tool.
Figure 3A:
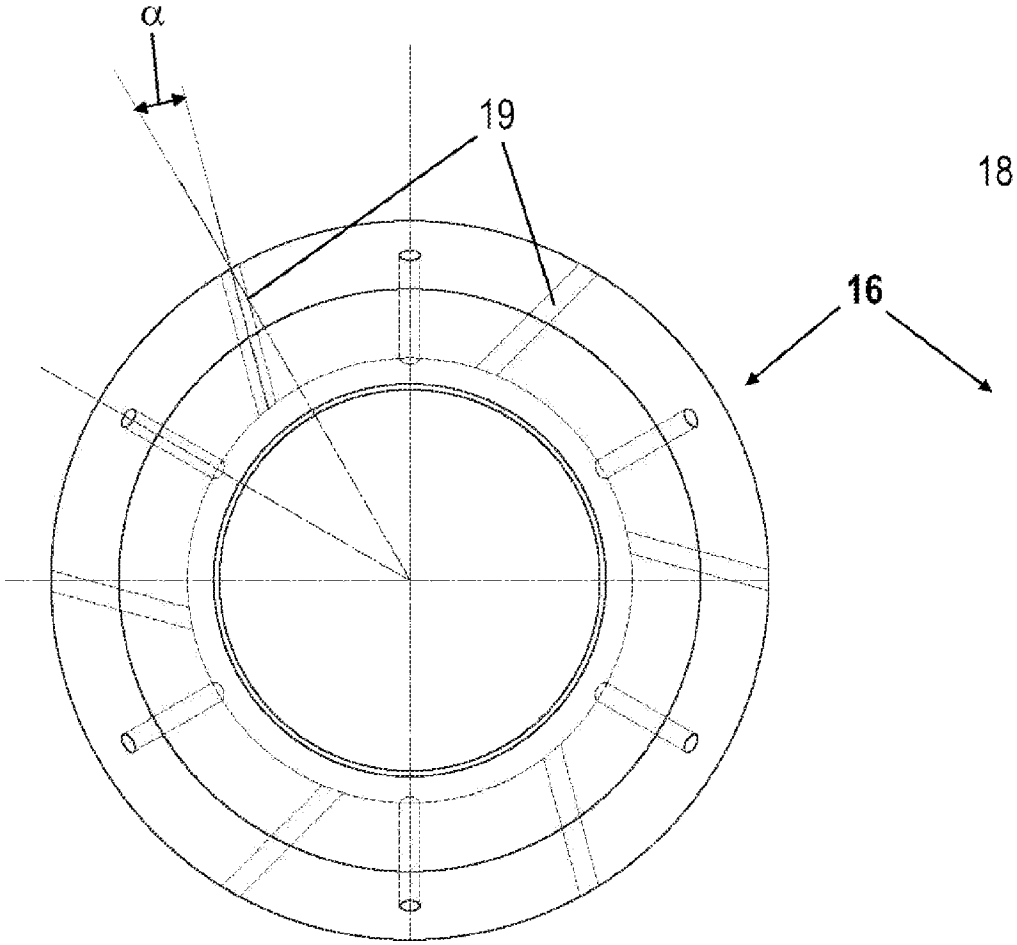

Turning now to FIGS. 3A-3B, a schematic view of an embodiment of the rotary hub 16 is shown further indicating the angles of the offset lateral bores 18 and the central lateral bores 19. In this depicted embodiment, six central lateral bores 19 and twelve offset lateral bores 18 are distributed at 60° intervals around the circumference of the rotary hub 16. In the embodiment depicted in FIG. 3A, the central lateral bores 19 are positioned at a 15° skew (indicated by $\alpha$) from the radius of the rotary hub 16, such that the central lateral bores 19 create multiple jets of fluid in a spiral configuration, thus driving the rotary hub 16 in a given direction. In FIG. 3B, the offset lateral bores 18 are shown at an angle of 30° (indicated by $\beta$) from the lateral axis of the rotary hub 16. It should be noted, of course, that all of the angles shown in FIGS. 3A-3B are representative and not definitive; different wash tools may be configured with different skews and angles to their side wash and central lateral bores 18, 19 as dictated by hole conditions, fluid characteristics, etc.

Figure 4B:
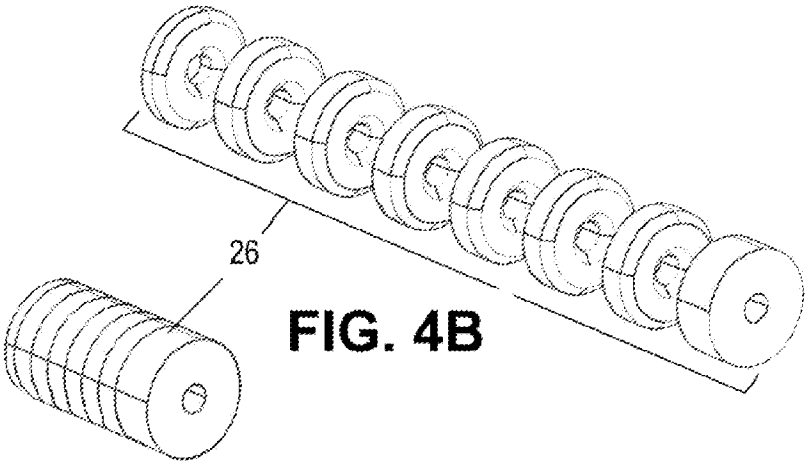
FIGS. 4A-4C depict an embodiment of the sealing connection of the wash tool and a detail view of the seals and packing gland.
Figure 4C:
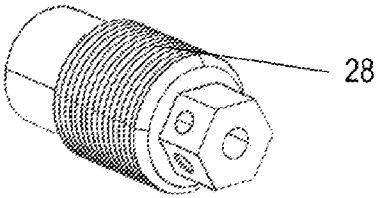
Figure 4A:
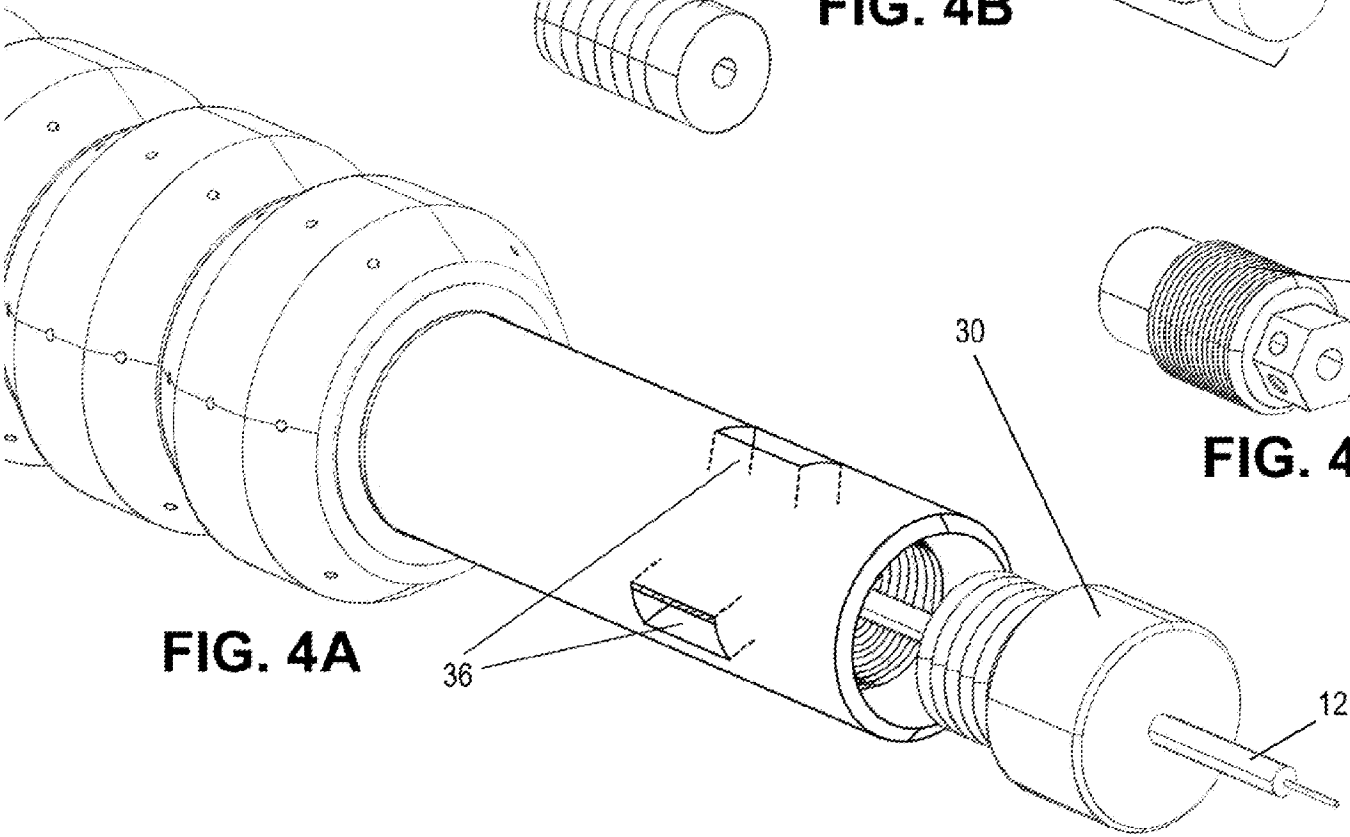

Turning now to FIGS. 4A-4C, an exploded view of the far end of an embodiment of the wash tool 10 is shown, in which the v-packing seal 26, packing gland 28, and connector 30 are all shown in greater detail as distributed along e-line cable 12. FIG. 4B depicts the v-packing seal 26 in both assembled form and exploded into individual rings. FIG. 4C depicts the packing gland 28 with, for example, a nut end having a series of flat holes for tightening via the access window 36. In the embodiment depicted in FIG. 4A, there are three access windows 36 located at 120° intervals around the circumference of the mandrel; as with most angles, this is representative and not definitive. Thus, the wash tool 10 can comprise any number of access windows 36 located at varying degree intervals around the circumference of the mandrel.

Figure 5:
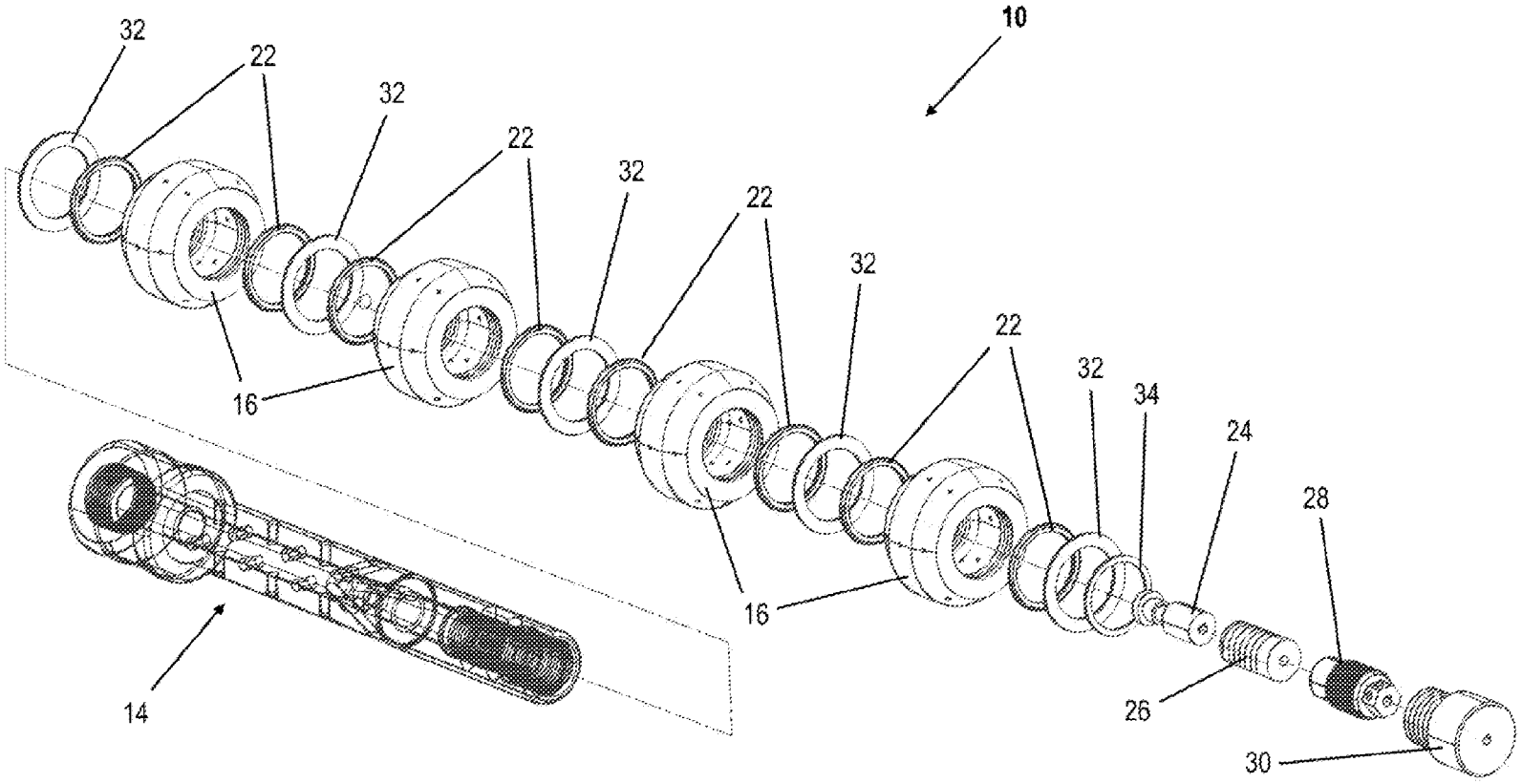
FIG. 5 depicts an exploded view of an embodiment of the sealing connection of the wash tool.

Turning now to FIG. 5, a full exploded view of an embodiment of the wash tool 10 is shown, in which the saline cable is eliminated for clarity, and the mandrel 14 is shown separately, while the remainder of the components are shown in assembly order. In this embodiment, each rotary hub 16 can be sealed with a pair of rotary seals 22, as well as separated from each other by a bearing plate 32, enabling the rotary hubs to freely rotate relative to each other without causing friction. The set of rotary hubs 16 can be kept in place with, for example, a final bearing plate 32 and retainer ring 34, allowed by at least one tie-back 24, at least one v-packing seal 26, at least one packing gland 28, and/or at least one connector 30.

Figure 6:
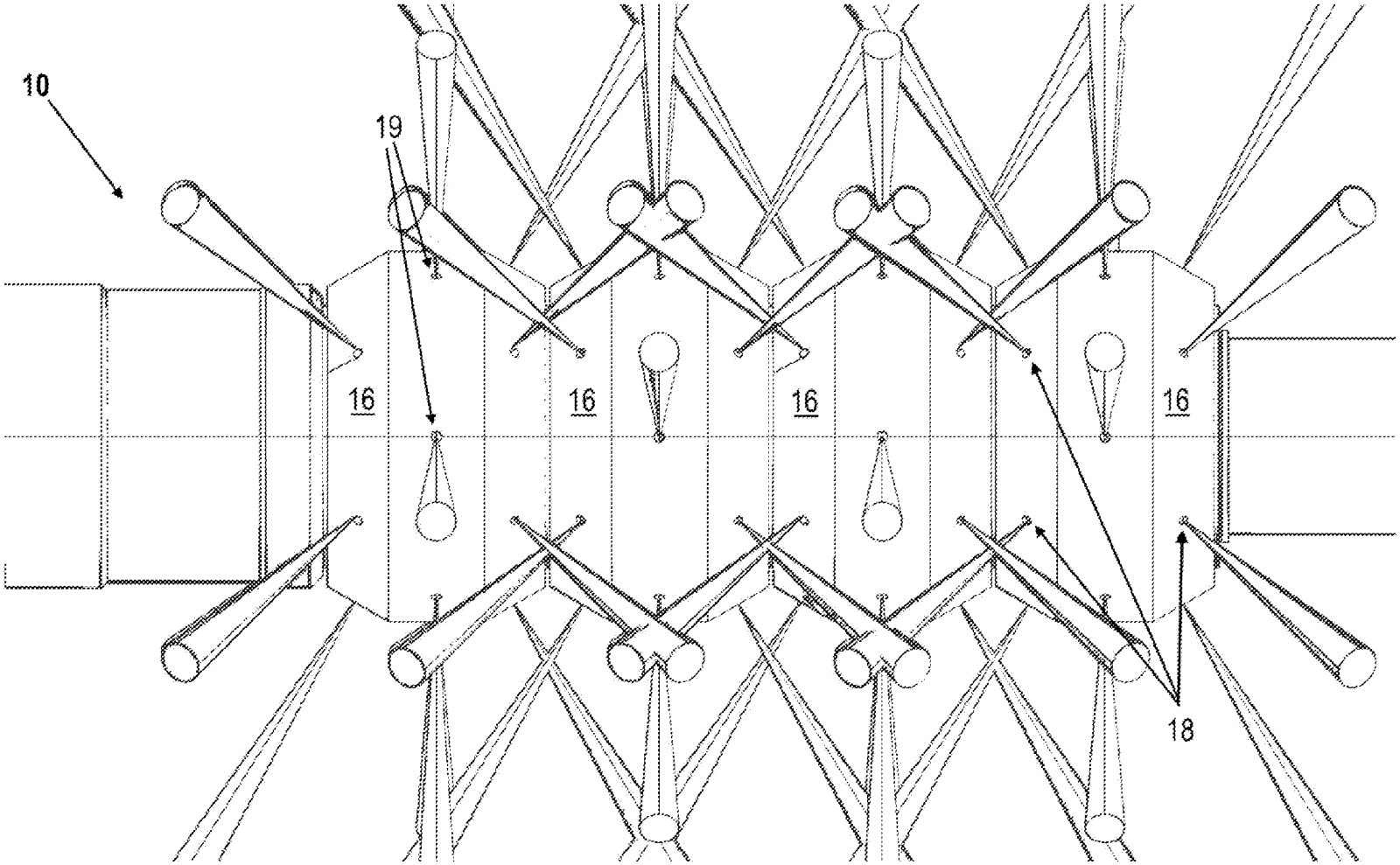
FIG. 6 depicts a side view of the wash tool with the flow paths of the jets out of the rotary hubs depicted as solid cones.

Turning now to FIG. 6, a 3-D model of the wash tool 10 is shown with flow paths for the wash fluid to flow out of the side wash and central lateral bores 18, 19, depicted as solid cones. In particular, FIG. 6 depicts clearly the alternating rotational configuration of the rotary hubs 16, as well as the varying angles taken by the wash fluid exiting offset lateral bores 18 and central lateral bores 19.

In an embodiment, some of the side offset and central lateral bores 18, 19, or an entire rotary hub 16, may be replaced with a brushing tool. For instance, some of the rotary hubs 16 in a given tool may only feature the central lateral bores 19 to rotate the hub, while the offset lateral bores 18 can be replaced with brushes such that the annulus can be both washed and abraded to remove any debris from operations.

While the tool has been depicted herein with four rotary hubs, it can be appreciated that more or less rotary hubs may be used without departing from the scope of this disclosure. In other embodiments, the tool may be adapted for use with non-electronic coil tubing or wire line applications, or for use with slickline (s-line) applications, or utilized at the terminus of a line, by plugging the wire port of the connector 30 (or utilizing a version of the connector 30 with the pass-through annulus omitted).

Figure 7A:
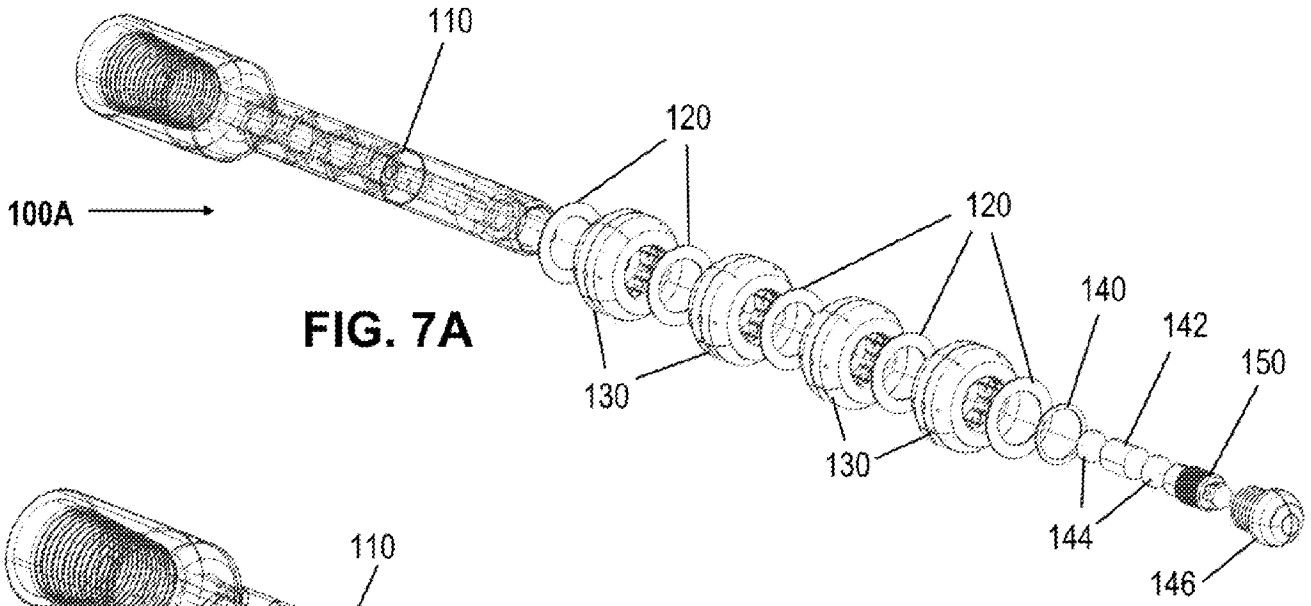
FIGS. 7A-7B depict two further embodiments of the wash tool, one a wireless embodiment and one wired.
Figure 7B:
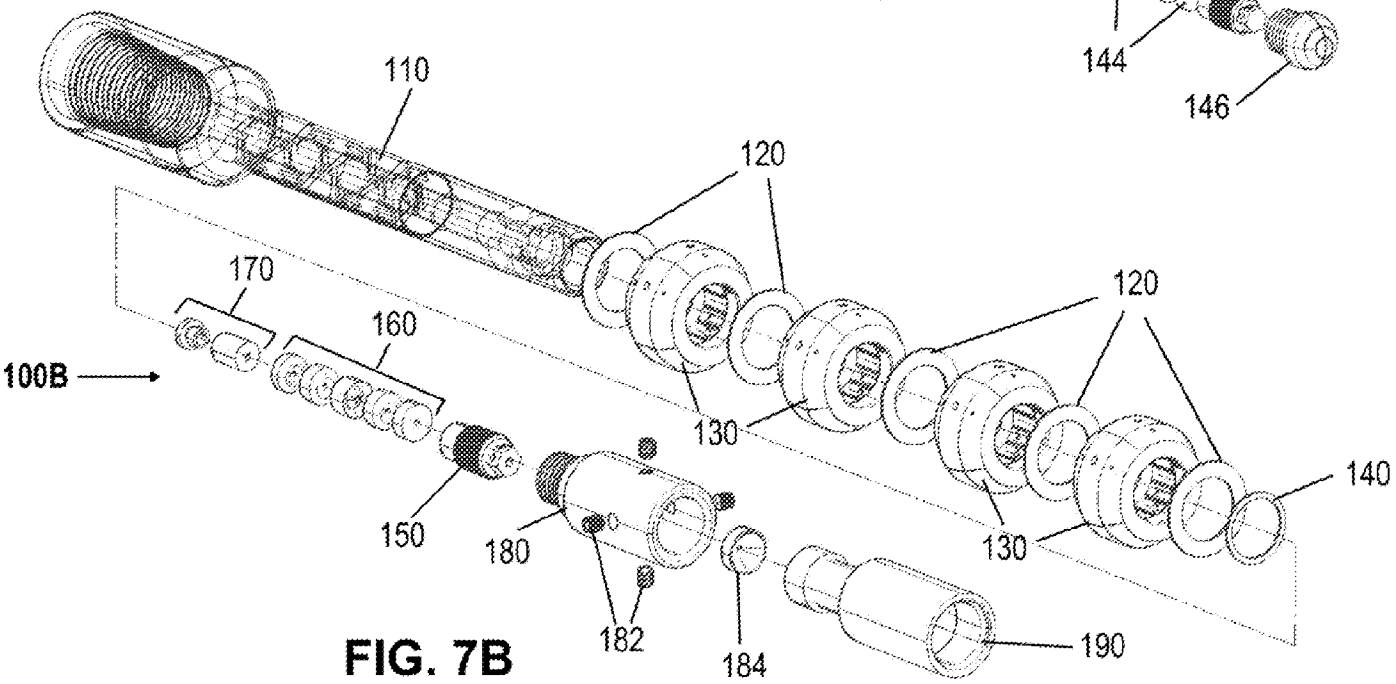

Turning now to FIGS. 7A-7B, two more embodiments of the wash tool 100A and 100B are shown in an exploded view. Wash tool 100A utilizes an end plug while wash tool 100B houses a wire, similar to the embodiment shown in FIGS. 1-6. Both embodiments comprise a mandrel 110, a plurality of bushings 120, a plurality of rotary hubs 130 separated from each other by the plurality of bushings 120, a retaining clip 140, and a packing gland 150. In an embodiment, the bushings 120 may be composed of ceramic. The wireless wash tool 100A further can comprise a packing seal 142 and two packing washers 144 at either end of the packing seal 142. Mandrel end cap 146, in conjunction with the packing seal 142 and packing gland 150, can be used to close off the internals of the wash tool 100A at the longitudinal end.

Figure 13B:
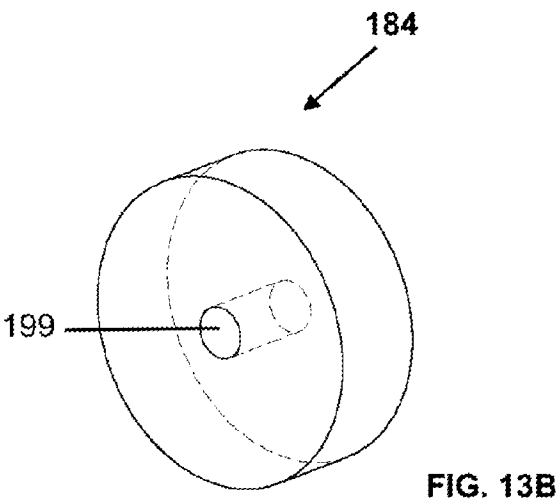
FIGS. 13A-13D depict detail views of various embodiments of components of the wired wash tool.
Figure 13A:
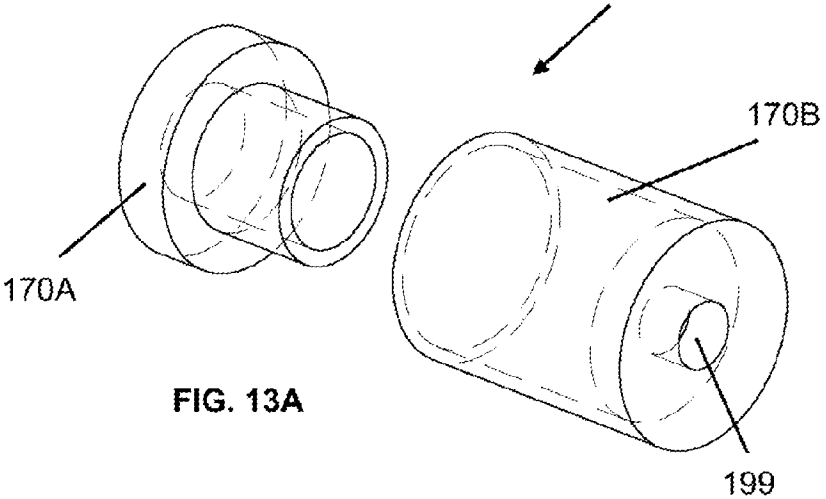
Figure 13C:
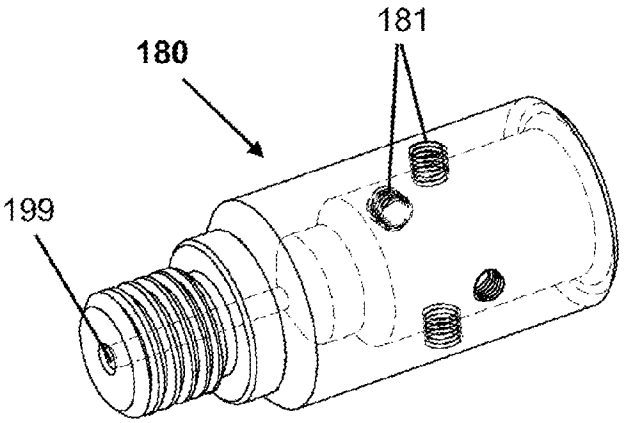

Wash tool 100B is an embodiment for use with a through-wire having differing internals. The packing gland 150 is present in this embodiment, but comprises an orifice for the wire. The seal and two packing washers are replaced by a series of five V-shaped packing seals 160 further depicted in FIGS. 11A-11E. Wash tool 100B additionally comprises a tie-back 170 comprising a male component 170A and a female component 170B for insulating and securing the wire along the longitudinal axis of the mandrel throughout (See FIG. 13A depicting male component 170A and female component 170B). Wash tool 100B further comprises a lower crossover 180, in lieu of the end cap 146 of the wireless embodiment shown in FIG. 7A, the lower crossover 180 being attached via four cup-point set screws 182, as well as a socketed bottom sub 190 and socket grommet 184 for securing further tools down the string, which may be electrically actuated beneath the wash tool 100B by means of the through-wire.

Figure 8A:
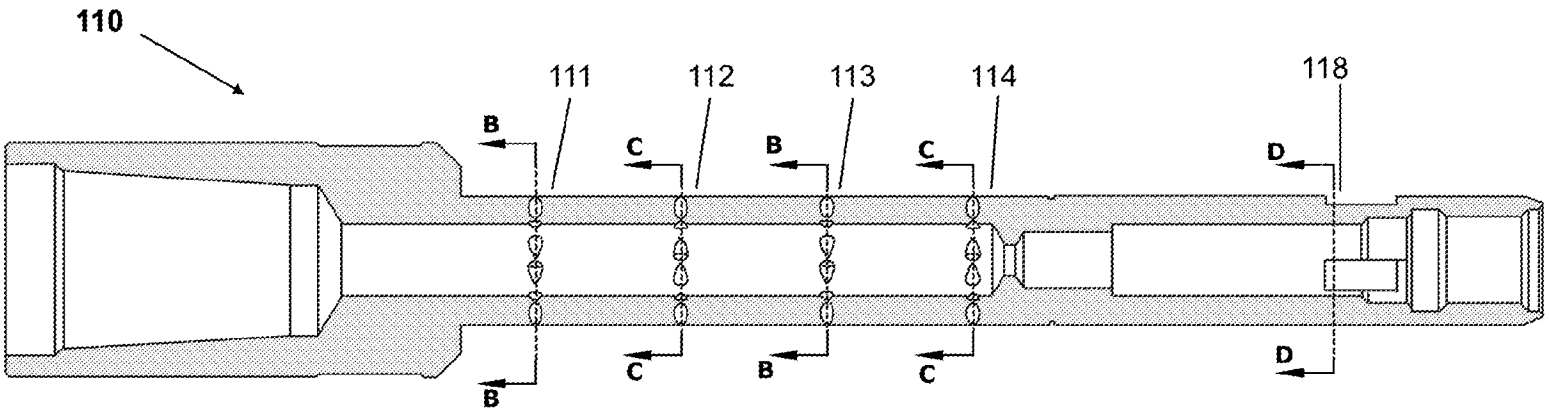
FIGS. 8A-8D depict a further embodiment of a mandrel component of the wash tool.
Figure 8C:
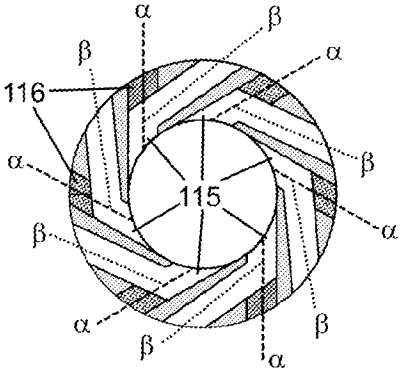
Figure 8B:
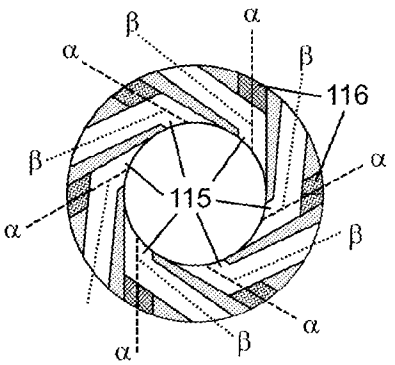
Figure 8D:
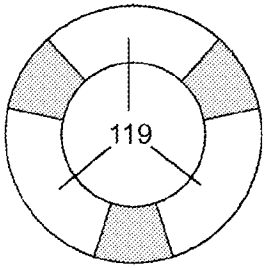

Turning now to FIG. 8A, the mandrel 110 of the previous embodiments 100A, 100B is shown in greater detail, in a longitudinal cross-section, with FIGS. 8B-8D depicting lateral cross-sections shown along section lines B-B, C-C, and D-D, respectively. In the depicted embodiment, mandrel 110 comprises a series of four lateral bores 111, 112, 113, and 114. Lateral bores 111 and 113 are represented by the B-B section lines, while lateral bores 112 and 114 are represented by the C-C section lines.

Turning to FIGS. 8B-8C, each of the lateral bores 111-114 along the body of mandrel 110 comprises a plurality of orifices 115 connecting the internal space of the mandrel 110 with the exterior of the tool. As is visible in cross-section, each of these orifices 115 comprises a non-linear, elbow shape. The lateral bores 111, 113 are identical to lateral bores 112, 114 with the exception of the orientation of the orifices 115, which are reversed between the B-type and C-type lateral bores. These orifices 115 are formed first by first drilling a starter port directly through the mandrel wall at an angle indicated by line α. Subsequently, an intersecting port is drilled through the mandrel wall at a shallower, offset angle indicated by line β. Once the intersecting ports connect the starter ports, the original starter ports are plug welded 116 (depicted over all orifices 115 but only two labeled for clarity), creating the final elbow-shaped lateral bores. The plug welds are subsequently smoothed via skim turn to a final outer diameter.

FIG. 8D depicts a gland port 118 (shown in FIG. 8A) which corresponds roughly with the location of the packing gland 150 and comprises a plurality of simple, linear window orifices 119 which do not feature the elbow shape of the lateral bores 111-114.

Turning now to FIGS. 9A-9E, the rotary hubs 130 of the wash tool embodiments 100A, 100B are shown in greater detail. Each hub comprises two machined halves 130A, 130B which are welded together after being internally shaped. The huh halves 130A, 130B each comprise a plurality of lateral bores 132 which are slightly skewed, similarly to the rotary hub embodiments of FIG. 3B (only some of the lateral bores 132 are labeled in FIGS. 9C and 9E for clarity). These lateral bores connect the outer surface of the rotary hubs 130 with the inner surface, which in turn abuts mandrel 110. Each rotary hub 130 is aligned with one of mandrel lateral bores 111-114.

Figure 9D:
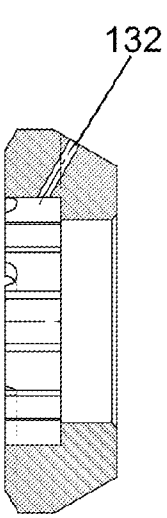
FIGS. 9A-9E depict a further embodiment of the rotary hum component(s) of the wash tool.
Figure 9E:
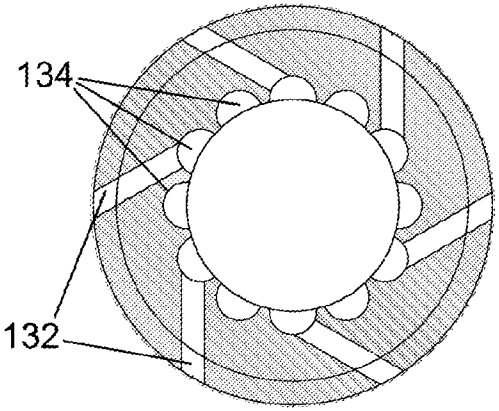
Figure 9A:
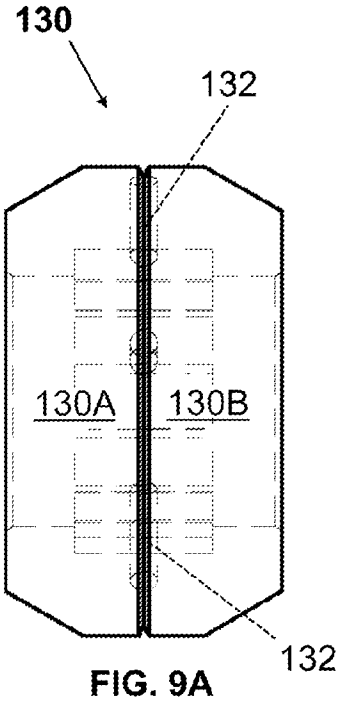
Figure 9B:
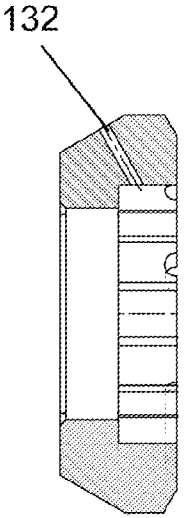
Figure 9C:
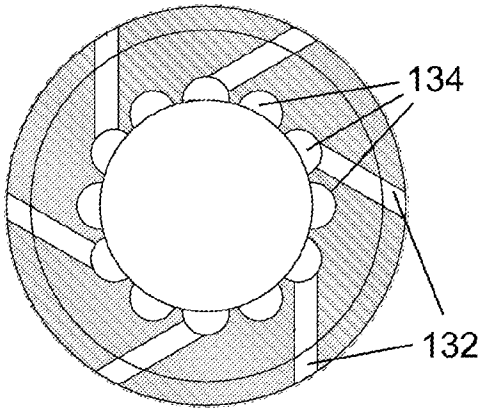

As water exits the lateral bores 111-114 of the mandrel 110 under pressure, it forms a jet which is guided through the lateral bores 132 of the rotary hub 130 into the external environment. The inner surface of rotary hub 130 (and each half 130A, 130B thereof) can comprise a plurality of semi-circular voids 134 (as with lateral bores 132 only some are labeled for clarity) shaped by circular punch-outs aligned around the inner diameter of the hub 130, and including lateral bores 132. These voids 134 create surfaces which act to rotate the hub 130 in place about the mandrel 110 as the pressurized fluid impacts them, ensuring wash spray is directed a full 360 degrees about the tool. In the depicted embodiment, each half of the rotary hub 130A, 130B is manufactured separately and the two are welded together as shown in FIG. 9A once the orifices and rotors have been drilled out. These enable frictionless rotation of the rotary hubs 130 on water bearings. In another embodiment, the manufacturing may drill the rotary hubs 130 out of a singular piece to aid consistency of the product and ensure balanced nozzle rotation.

Figure 10E:
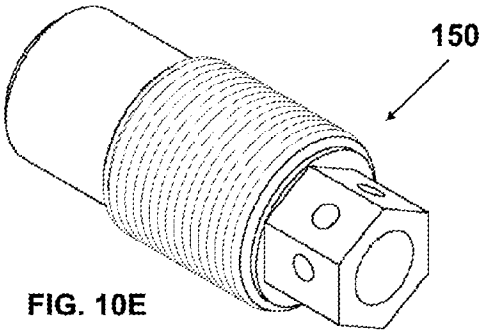
FIGS. 10A-10H depict further embodiments of the packing gland component of the wash tool.
Figure 10A:
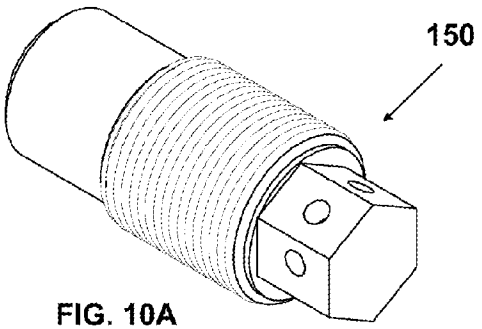
Figure 10F:
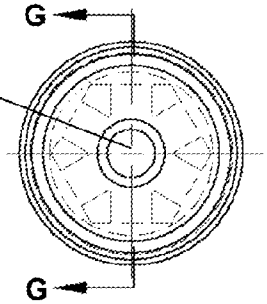
Figure 10H:
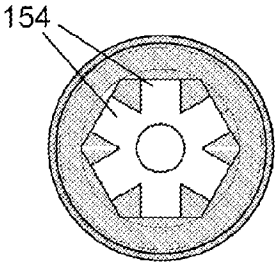
Figure 10G:
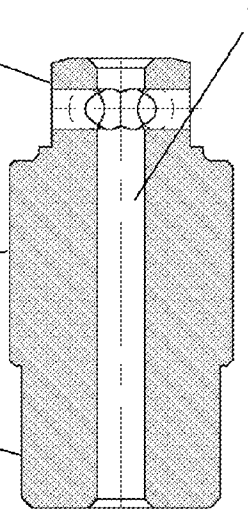
Figure 10C:
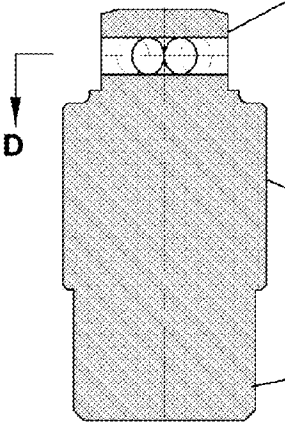
Figure 10B:
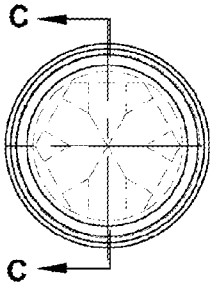
Figure 10D:
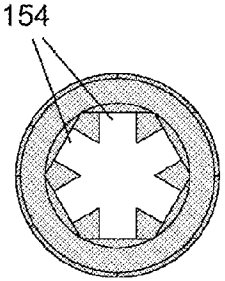

Turning now to FIGS. 10A-10H, the packing gland 150 is shown in two different embodiments. The wireless embodiment of FIG. 7A is depicted in FIGS. 10A-10D, while the wired embodiment of FIG. 7B is depicted in FIGS. 10E-10H. As shown, in the respective cross-sections of FIGS. 10C and 10G, the packing gland 150 comprises a hexagonal wrench head 151, a wide, threaded section 152, and a base 153. Wrench head 151 of packing gland 150 additionally comprises a series of through ports 154 (only two pointed out for clarity) which together permit the packing gland to be easily tightened via manual or mechanical manipulation through the gland port 118 (depicted in FIGS. 8A & 8D). Central annulus 155 as depicted in FIGS. 10F and 10G houses the wireline.

Figure 11A:
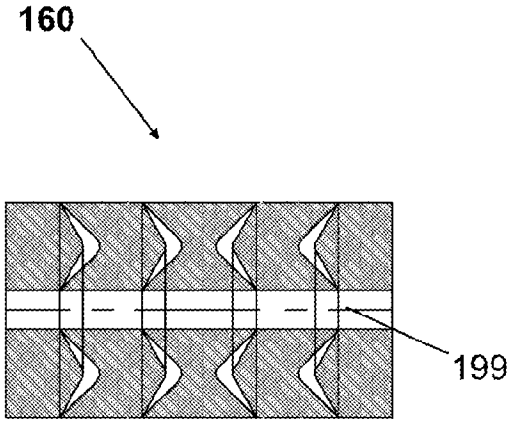
FIGS. 11A-11E depict farther embodiments of the sealing connection of the wash tool.
Figure 11B:
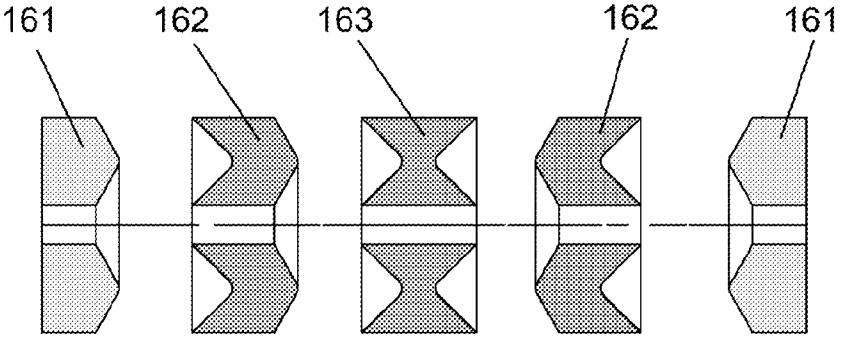
Figure 11C:
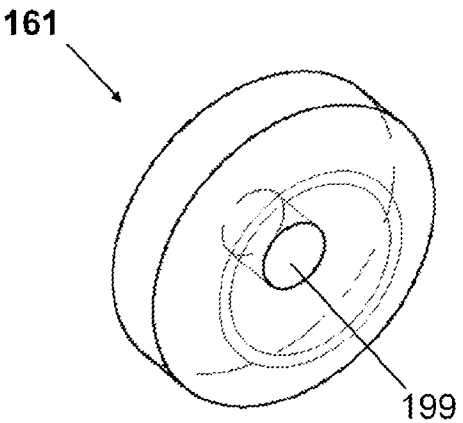
Figure 11D:
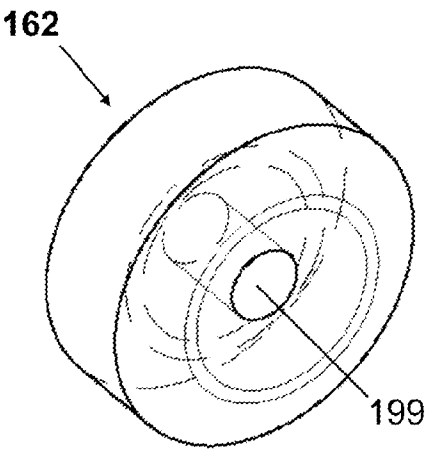
Figure 11E:
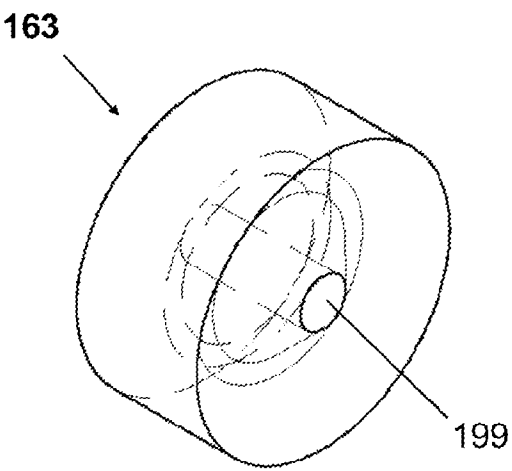

Turning now to FIGS. 11A-11E, the V-shaped packing seals 160 of the wired embodiment, depicted previously in FIG. 7B, are shown in more detail. V-shaped packing seal 160, as shown, comprises two outer seals 161, two middle seals 162, and an innermost seal 163. FIG. 11B shows the seals 161-163 in an exploded view. Each seal is gapped slightly within the space between the through-wire orifice 199, shown in FIG. 11A, and the external surface of the V-shaped packing seal 160, allowing for the packing gland 150 to be threaded against the seal and, thus, compress the individual seals against each other. The contours of individual packing seals 161, 162, 163 are shown in perspective in FIGS. 11C, 11D, and 11E, respectively.

Figures 12A, 12B, 12C:
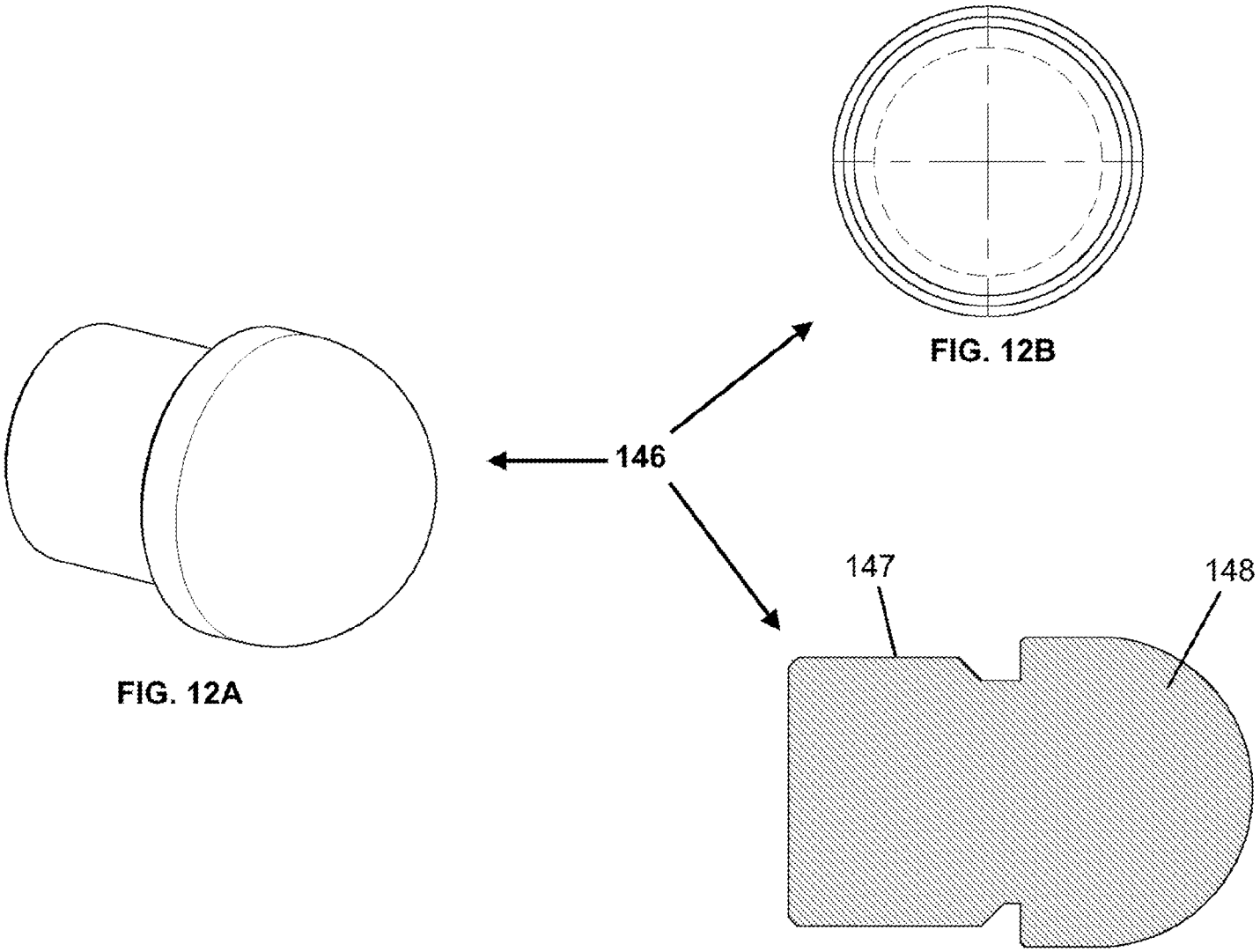
FIGS. 12A-12C depict an embodiment of the wireless end cap of the wash tool.

Turning now to FIGS. 12A-12C, an embodiment of the wireless end cap 146 is shown in perspective as well as lateral and longitudinal cross-section. As shown, the wireless end cap 146 can be a solid piece of metal comprising a cylindrical base 147 and a knob head 148, and can exist and be usable for covering the packing gland and protecting the bottom end of the tool.

Figure 13D:
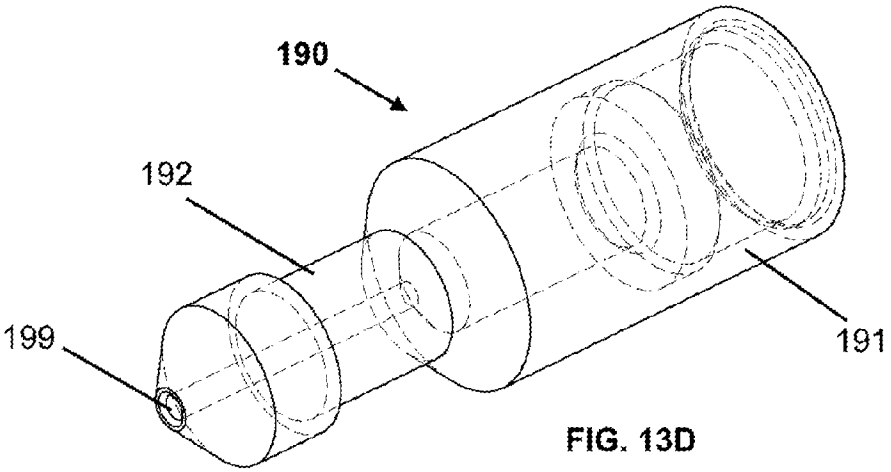

Finally, turning to FIGS. 13A-13D, the wired embodiments of the tie-back 170, lower crossover 180, socket grommet 184, and socket 190 are shown, respectively, in further detail. As previously depicted, the tie-back, shown in FIG. 13A, can comprise a male portion 170A and a female portion 170B. Lower crossover 180, shown in FIG. 13C, can comprise bolt holes 181, which can receive set screws 182 as shown in FIG. 7B. In an embodiment, these screws 182 may be shearable, enabling the tool to disconnect at the lower crossover 180 above the remaining tools down the string. Socketed bottom sub 190, as shown in FIG. 13D, can comprise a cylindrical body 191 and a knob head 192 that enables the knob head to be more easily manipulated in the case of a disconnected lower crossover 180. All components of the wired embodiment feature a central wire orifice 199.

Figure 14A:
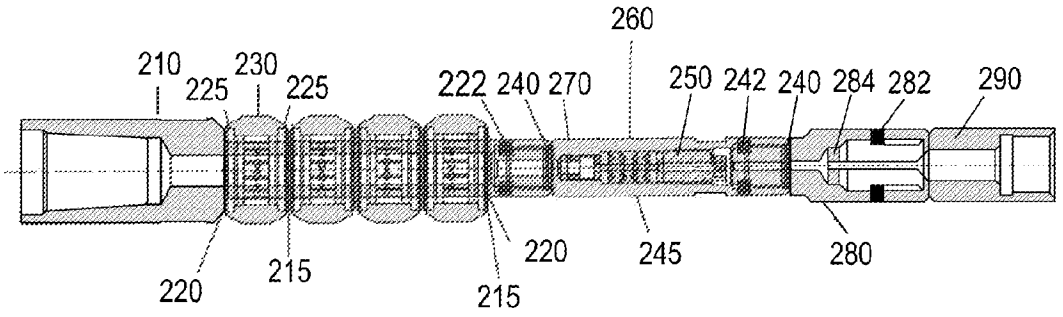
FIGS. 14A-14B depict a built and exploded cross-section of further embodiments of the wash tool.
Figure 14B:
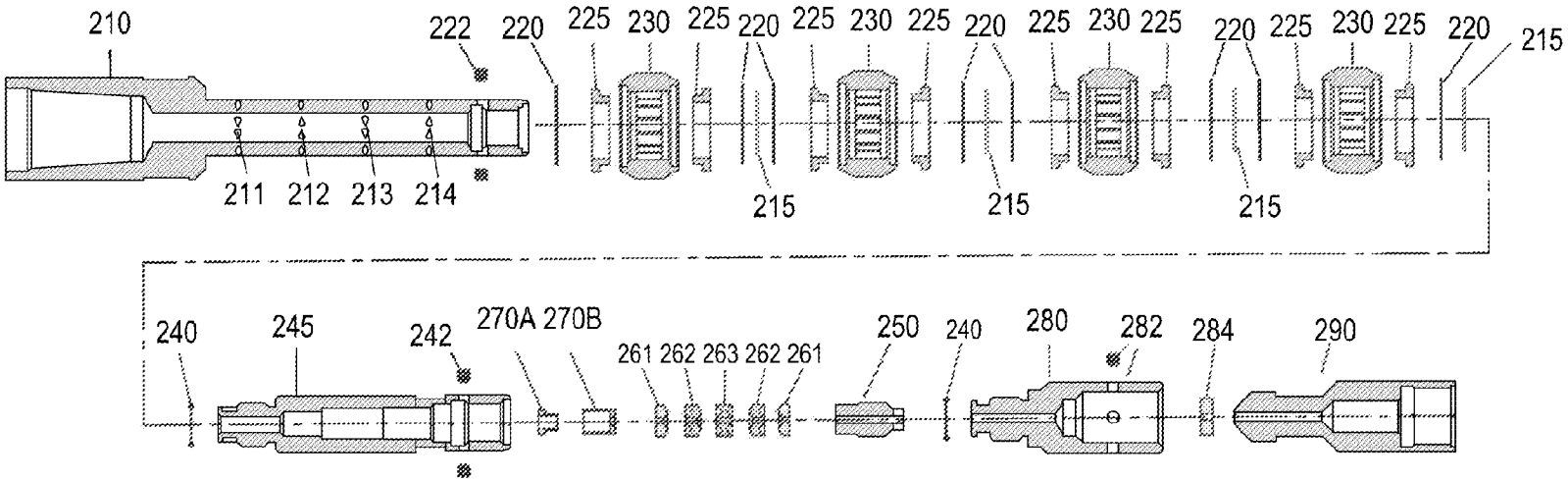

Turning now to FIGS. 14A-14B, another embodiment of the wired wash tool 200 is depicted in cross-section, assembled and exploded. This embodiment comprises a mandrel 210 having lateral bores 211-214 similar to the previous embodiment. Lateral bores 211-214, shown in FIG. 14B, correspond to rotary hubs 230, shown in FIG. 14A, which in this embodiment further comprise carbide inserts 225 which are inserted into each rotary hub 230 on either side to improve rotation of the rotary hubs 230. As with previous embodiments, the rotary hubs 230 can be separated by bushings 220. The embodiment additionally comprises external retaining clips 215 which attach between various rotary hubs 230. These retaining clips may be selectively removed or attached to allow various rotary hubs 230 to rotate independently of one another or not.

Wash tool 200 further comprises a seal sub 245 in line between the mandrel 210 and mandrel crossover 280. Seal sub 245 can house the tie-back 270, the V-shaped packing seal 260, and the packing gland 250 separately from the mandrel 210. Tie-back 270, packing seal 260, and packing gland 250 are all constructed and function similarly to their counterparts 170, 160, and 150, respectively, as described above and depicted in in FIGS. 13A, 11A-E, and 10A-H, respectively. Thus, V-shaped packing seal 260 comprises two outer seals 261, two middle seals 262, and an inner seal 263, while tie-back 270 comprises a male portion 270A and a female portion 270B, functioning similarly to previous embodiments.

The proximate end of seal sub 245 is secured within mandrel 210 by means of a plurality of cup-point set screws 222; the proximate end of lower crossover 280 is secured within seal sub 245 by a similar plurality of set screws 242. (Although this embodiment depicts these components with two set screws each, it can be appreciated that other configurations may be possible, e.g., four set screws as with the lower crossover 280 and bottom sub 290). Also present in this embodiment are O-rings 240 that help seal the respective joins between mandrel 210 and seal sub 245, and between the seal sub 245 and mandrel crossover 280. Set screws 282 attach lower crossover 280 to bottom sub 290, which are also joined by washer 284.

Figure 15A:
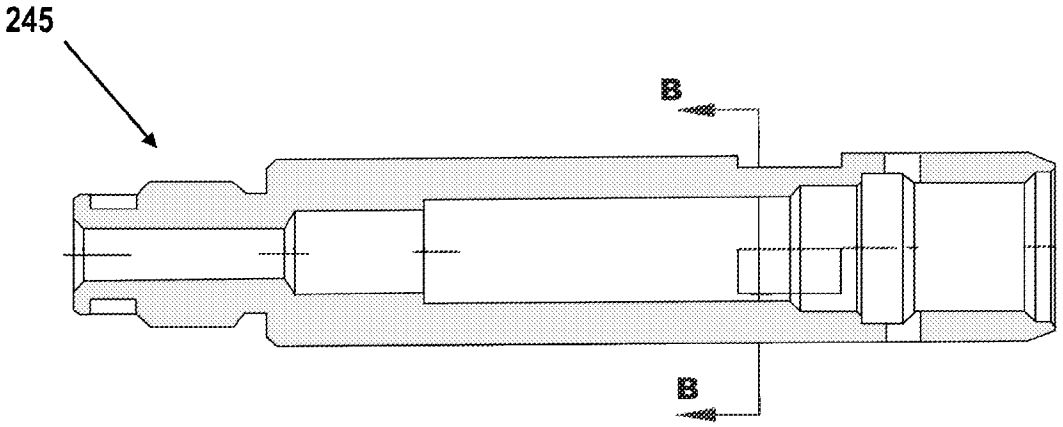
FIGS. 15A-15B depict an embodiment of the seal sub in greater detail.
Figure 15B:
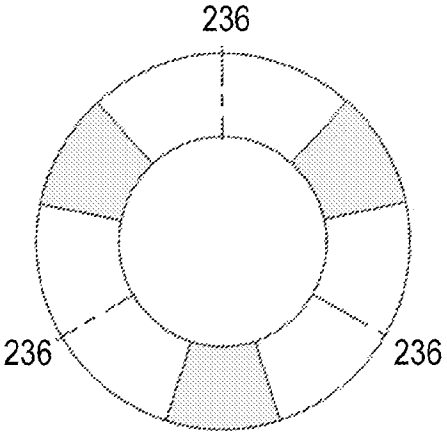

Turning now to FIGS. 15A-15B, the seal sub 245 is shown in a cross-section in greater detail. In particular, it can be seen that the seal sub 245 can comprise a plurality of access windows 236 which function similarly to the access windows 36 of the unitary mandrel embodiment depicted in FIGS. 1A-1B (i.e., permitting access to packing gland 250 such that the seal sub 245 can be tightened or loosened on and off a slickline).

Figure 16B:
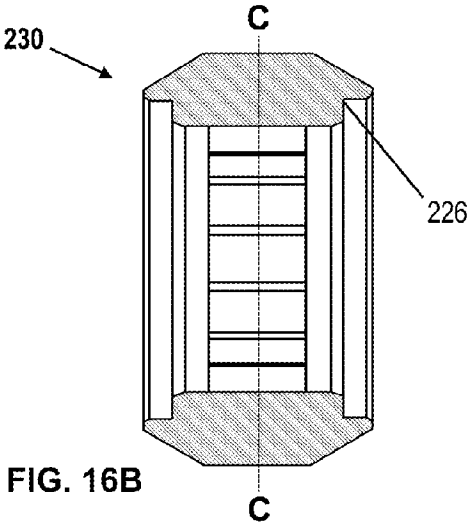
FIGS. 16A-16D depict embodiments of the rotary hubs in greater detail.
Figure 16D:
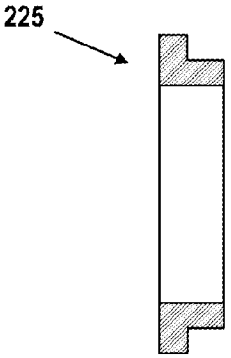
Figure 16A:
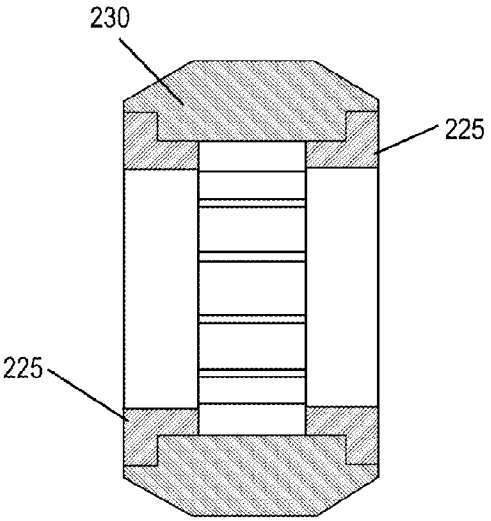
Figure 16C:
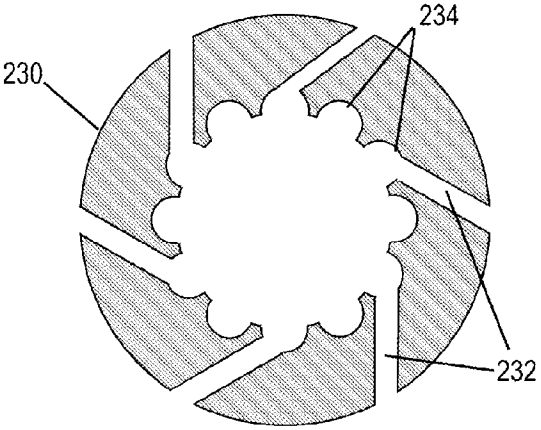
Figures 17A, 17B, 17C, 17D:
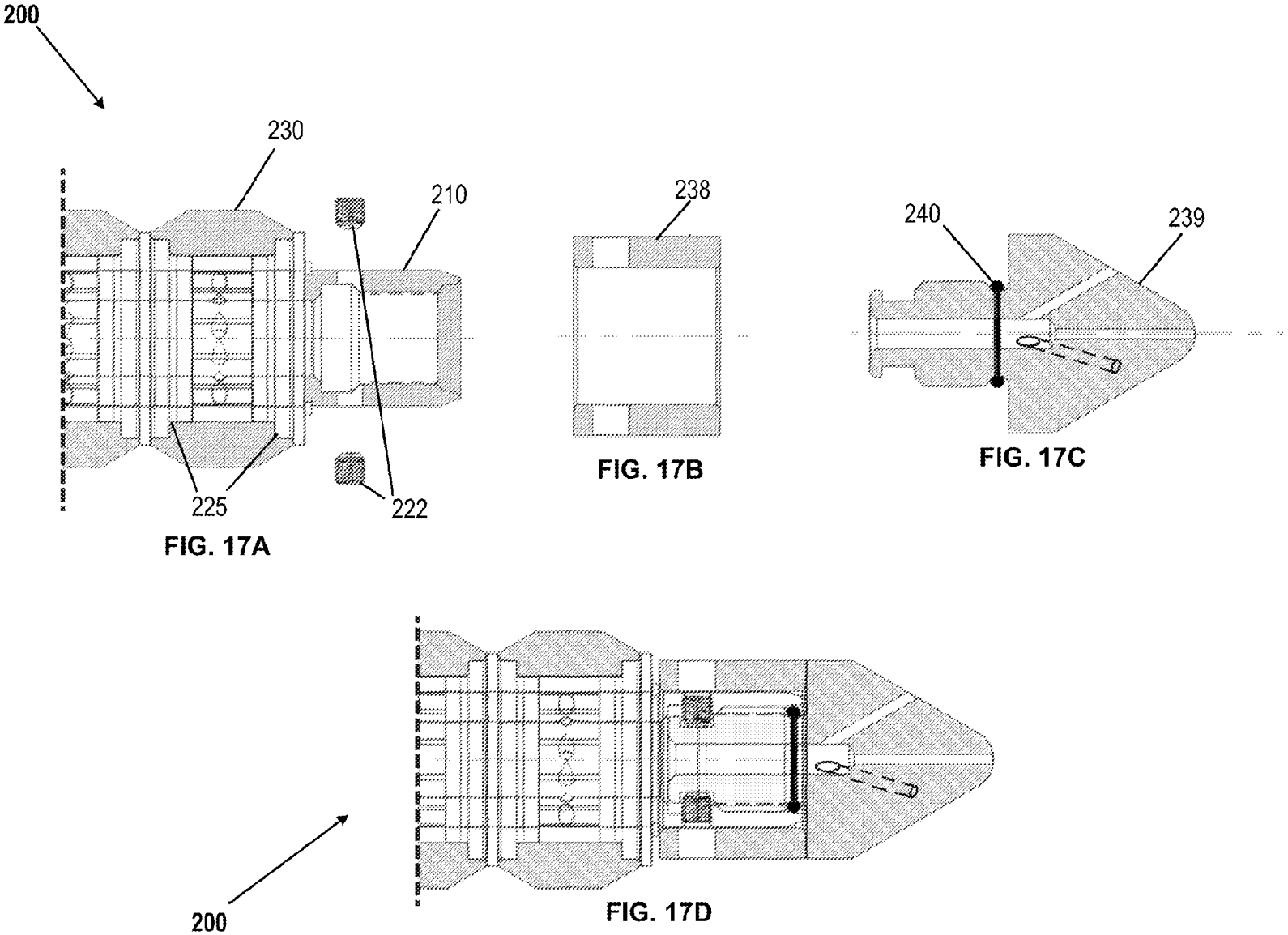
FIGS. 17A-17D depict an end cap of a wireless embodiment of the wash tool.

Turning now to FIGS. 16A-16D, the rotary hubs 230 are shown in greater detail, alongside the carbide inserts 225, which are shown in FIGS. 16A and 16D. The carbide inserts 225 can be inserted into corresponding stepped receiving surfaces 226 concentric to the central orifice of the rotary hubs 230, as shown in FIG. 16B. Cross-section C-C, depicted in FIG. 16C, shows rotary hubs 230 with similar lateral bores 232 and internal semi-circular voids 234 as with the embodiment depicted in FIGS. 9A-9E.

Turning now to FIGS. 17A-17D, an alternate embodiment of the wash tool 200 is shown in for use without a wireline/slickline. In this embodiment, the various seals and packing components are no longer required to perform their isolation functions and so the seal sub 245 and components distal from it are omitted. Instead, subsequent to the final rotary hub 230 and carbide inserts 225, the mandrel 210 is attached to a spacer 238, depicted in FIG. 17B, through which set screws 222 connect an end cap 239, depicted in FIG. 17C. End cap 239, sealed with O-ring 240, further comprises a variety of lateral bores, allowing end cap 239 to function as a supplemental, final fluid source. The shortened wireless assembly of the wash tool 200 is shown assembled in FIG. 17D.

Turning now to FIGS. 18A-18B, two alternate embodiments of the wash tool 300 are shown: FIG. 18A shows a wired tool 300A with signal wire 305 and FIG. 18B shows a wireless tool 300B. As with the above embodiments, the wash tool comprises a mandrel 310 and a plurality of rotary hubs and bushings 330, wherein the mandrel 310 comprises elbow-shaped lateral bores similar to those depicted in FIGS. 8A-8D and the rotary hubs are constructed similarly to those depicted in FIGS. 16A-16D. These embodiments additionally comprise nose cones 339A (wired) and 339B (wireless). The upper end of nose cones 339A and 339B are mounted to the mandrel 310 by means of set screws, which also extend through an outer spacer 338 which acts as a sleeve, similarly to the spacer 238 depicted in FIGS. 17A-17D, loosely bracing the lowermost bushing and affixing the rotary hubs and bushings in vertical position while allowing them to rotate.

In the depicted embodiment, nose cones 339A and 339B comprise lateral bores for additional fluid egress, which are blocked either by the closed end of the wireless nose cone 339B or the O-ring seals 340 and blunt end of the tie-back 370 in the wired nose cone 339A. Aside from being housed in the nose cone 339A, tie-back 370 otherwise functions similarly to tie-backs of previous embodiments (24, 170, 270). The wired embodiment 339A further comprises a sealing sub 345 which houses sells 360 (again functioning similarly to previous embodiments 160, 260), as well as lower crossover 380 and bottom sub 390 (constructed similar to previous embodiments 280, 290) having a socket for down-string wireline tools. Sealing sub 345 also comprises an access window 336 (functioning similar to the access windows 236 of seal sub 245 depicted in FIGS. 15A-15B) allowing access to the packing gland 350 (constructed similar to previous embodiments 150, 250)

These embodiments additionally illustrate the use of the tools 300 with a top sub 301, which may comprise a pin screen (or mesh) filter 302 and a centralizer 303. The top sub 301 may be attached to the mandrel 310 by means of upper crossover 304.

FIG. 18C depicts the pin screen filter 302 in more detail as utilized in the wired embodiment. In the embodiment, filter 302 comprises a packing gland 302*b* which fits into an orifice 302*a* at the tip of the filter 302 and sits on a seal 302*c*. This, combined with the flared head of the filter 302 settling on the internal shoulder 308A of the top sub 301, permits the entire wash tool 300 to hang off of a rope rather than be physically threaded onto a mandrel or second tool, permitting greater freedom of movement downhole.

FIG. 18D depicts the sleeve 338 and nose cone 339A of the wired embodiment 300A in more detail. (For compactness, the right side of the figure is depicted in cross-section while the left side is depicted side-on.) The embodiment depicted here comprises an alternate shape for the rotary hubs 330 which comprise spirals in which pressurized fluid exiting the lateral bores creates an upward vortex aiding in conveying any debris away from the lower wireline tools. Bushings 320 separate the rotary hubs and serve the same function as in 120 and 220 in above-depicted embodiments. Although obscured by the side view, the internal surfaces of the rotary hubs 330 embodied here also semi-circular voids 234 of the rotary hubs 230 depicted in FIG. 16C, and the stepped carbide inserts 225 depicted in FIG. 16A.

FIG. 18D also shows the nose cone 339A and the tie-back 370, now separated from the sealing sub 345 and seals 360. Sleeve 338 braces the final bushing 320 and is secured to the intersection of the mandrel 310 and nose cone 339A with set screws 342. Set screws 342 also secure the nose cone 339A to the sealing sub 345. The tie-back 370 is also protected from fluid interference by O-rings 340 sealing off both sides of the nose cone 339A and ensuring fluid exits the lateral bore of the nose cone 339A.

Figure 19A:
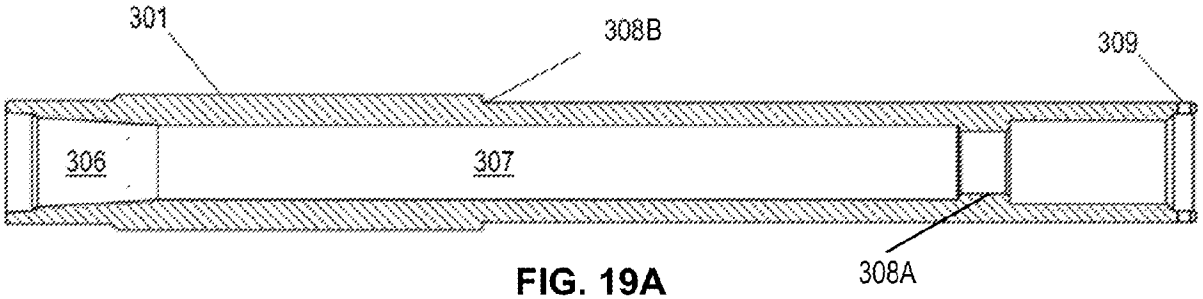
FIGS. 19A-19D depict top sub components for use with embodiments of the wash tool.
Figure 19B:
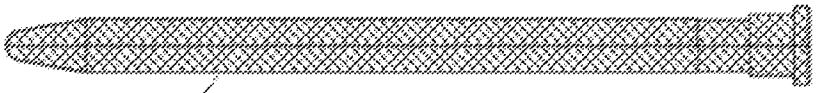
Figure 19C:
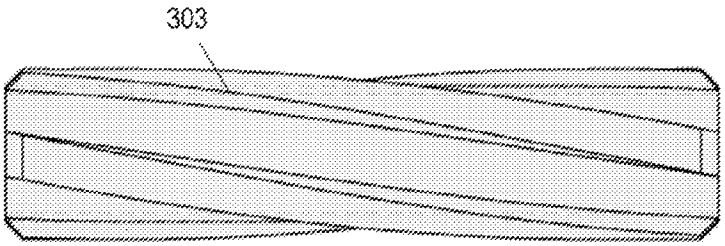
Figure 19D:
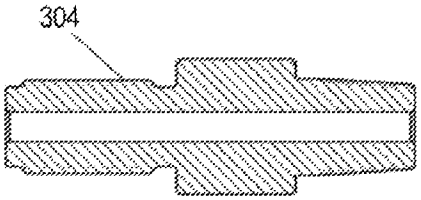

Turning now to FIGS. 19A-19D, the FIGS. depict each of the above components in separate detail. In particular, FIG. 19A depicts the top sub 301 that comprises an upper socket cavity 306 tapering into an inner cavity 307, which houses the filter 302 (shown in FIG. 19B). As shown, the top sub 301 can additionally comprise an internal shoulder 308A and an external shoulder 308B which hold the filter 302 and centralizer 303 (shown in FIG. 19C) in place, respectively. Top sub 301 can be attached to upper crossover 304 (shown in FIG. 19D) by means of set screw sockets 309 which function similarly to other set screw socket attachments (e.g., seal sub 245 as depicted and described in FIGS. 14A-14B).

Centralizer 303 is depicted here in a spiral, four rib configuration although it can be appreciated that other centralizer configurations may be used (e.g., straight ribs, more or less than four ribs). In other embodiments, centralizer 303 may be replaced with a scraping tool. In an embodiment, filter 302 comprises a pin screen filter, in which several layered meshes act to strain any debris from the environment or from recycled water before it continues through cavity 306 and into the remainder of the wash tool 300 fouling up smaller orifices. The modular construction of the top sub 301 and top sub crossover 304, as well as mandrel crossover 245 (depicted in FIGS. 14A-14B), permit multiple configurations to be assembled (e.g., the tool may be doubled up with eight rotary hubs instead of four).

Figure 20:
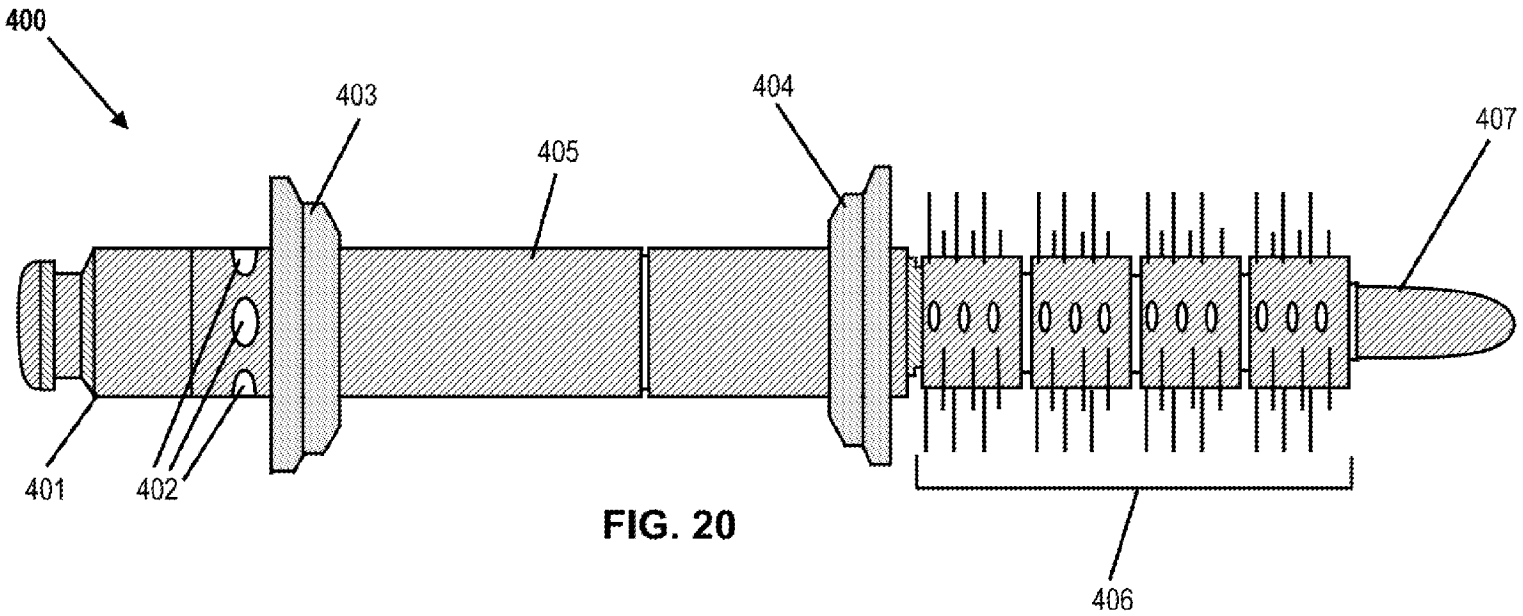
FIG. 20 depicts another embodiment of the wash tool use with a non-conductive wireline or rope.

Turning now to FIG. 20, still another alternate embodiment of the wash tool 400 is shown being configured for use with a rope attachment, being particularly suitable for use in non-coil tubing (i.e., pipe) environments. Wash tool 400, as shown, comprises a rope socket 401 with a similar internal packing gland (not shown) as the embodiment shown in FIG. 18C for attachment to a rope. An upward-facing pressure force cop 403 forces water to be directed towards inlet ports 402, where it is then directed through a non-rotating centralizer 405 having an internal filter (not shown, similar to FIG. 19-19A).

In the embodiment depicted in FIG. 20, the rotary hubs 406 comprise a series of brushing bristles in lieu of water outlets, enabling the inner diameter of the pipe to be abrasively cleaned as well as washed. (In an embodiment, these may be mixed, i.e., a rotary hub 406 may comprise both fluid outlets and brush bristles). A second, downward-facing cup 404 prevents flowback of water and debris. Finally, a nose cone 407 may comprise a pressurized nozzle to further direct fluid. In a further embodiment, the nose cone 407 may be constructed with lateral bores similarly to the embodiment depicted in FIG. 17C.

While various embodiments, usable within the scope of the present disclosure, have been described with emphasis, the wash tool is modular and the components of the various embodiments shown herein, including the unitary mandrel embodiment 10, the embodiment 100 having a bottom crossover, the embodiment 200 having a separate sealing sub, the embodiment 300 having a nose cone and a top sub, and the embodiment 400 having the external cups, may be usable with other embodiments where physically compatible without departing from the scope of the disclosure. (e.g., it may be possible to use the stepped insert punch-out rotary hubs of FIGS. 16A-16D with the integrated one-piece mandrel of FIG. 1A-1B).

Additionally, it can be appreciated that while the tool is primarily designed for use in downhole bores, it may also have uses in other fields, e.g., it may be usable in a plumbing setting to deliver a liquid cleaning or treating solution to the inner surface of a pipe or other conveyance.

The invention claimed is:

1. A tool for dispersing fluid within a tubular or a wellbore comprising:

a mandrel comprising a longitudinal axis, a central annulus along the longitudinal axis, and a plurality of lateral bores extending from an outer surface of the mandrel through the mandrel to the central annulus;

a plurality of rotary hubs mounted about the outer surface of the mandrel, each rotary hub comprising a plurality of lateral bores extending therethrough; and a plurality of bushings about the outer surface of the mandrel, disposed between adjacent pairs of the plurality of rotary hubs, plurality of rotary hubs, wherein the plurality of bushings permit the plurality of rotary hubs to rotate freely about the longitudinal axis of the mandrel, wherein the plurality of lateral bores of the one or more rotary hubs are angled perpendicular to the plurality of lateral bores of the mandrel, wherein fluid flowing from the central annulus, through the plurality of lateral bores of the mandrel, impacts the plurality of lateral bores of each rotary hub, causing the plurality of rotary hubs to rotate about the longitudinal axis and disperse the fluid outwardly into the tubular or the wellbore.

2. The tool of claim 1, further comprising:

a wireline extending through the central annulus of the mandrel; and a tie-back comprising a male member and a female member, wherein the male member is concentric to the wireline and secures the wireline with an insulating material, and wherein the female member is concentric to the male member and braces against a sealing sub.

3. The tool of claim 2, wherein a plurality of seals are located within a central annulus of the sealing sub and concentric to the wireline, and wherein an upper end of the sealing sub is attached to a lower end of the mandrel.

4. The tool of claim 3, wherein a packing gland is located within the central annulus of the sealing sub, wherein the packing gland is concentric to the wireline and abuts the plurality of seals, wherein the packing gland comprises a threaded portion, a wrench head portion, and an orifice for the wireline, and wherein the sealing sub comprises internal threads interfacing with the threaded portion of the packing gland and an access window positioned concentric to the wrench head portion of the packing gland for selective manipulation of the packing gland.

5. The tool of claim 4, wherein a lower crossover member is attached to a lower end of the sealing sub, and a bottom socket is attached to a lower end of the lower crossover member, wherein the lower crossover member and the bottom socket comprise a central annulus concentric to the wireline, and wherein the bottom socket can accommodate additional tools to be controlled by the wireline.

6. The tool of claim 1, wherein the plurality of lateral bores of the mandrel comprise a first angle and a second angle, wherein the second angle is less shallow than the first angle to produce an elbow shaped bore, causing the fluid to exit the central annulus of the mandrel at the first angle and exit the lateral bore of the mandrel at the second angle.

7. The tool of claim 6, wherein the plurality of lateral bores of the mandrel comprise alternating orientations, such that adjacent lateral bores of the plurality of lateral bores cause adjacent rotary hubs to spin in opposite directions.

8. The tool of claim 1, wherein the plurality of rotary hubs comprise inner surfaces, wherein the inner surfaces comprise semi-circular voids, and wherein the impact of the fluid on the inner surfaces of the plurality of rotary hubs causes their rotation.

9. The tool of claim 1, wherein each rotary hub of the plurality of rotary hubs further comprises a pair of carbide inserts.

10. The tool of claim 1, wherein a nose cone is attached to a lower end of the mandrel, wherein the nose cone comprises a central annulus and a plurality of lateral bores perpendicular to the central annulus, and wherein the lower end of the nose cone is obstructed to force any remaining fluid out of the lateral bores of the nose cone.

11. The tool of claim 1, wherein a top sub is attached to an upper end of the mandrel by means of an upper crossover, and wherein the top sub and upper crossover comprise a central annulus.

12. The tool of claim 11, wherein the central annulus of the top sub houses an elongate pin screen filter, wherein a lower end of the elongate pin screen filter is braced against an inner shoulder of the top sub by the upper crossover, and wherein the elongate pin screen filter extends into the central annulus of the top sub and filters the fluid prior to entering the mandrel.

13. The tool of claim 12, wherein the elongate pin screen filter comprises a central annulus and a flared socket located at an upper end of the elongate pin screen filter, wherein the flared socket houses a packing gland and a seal between the packing gland and the central annulus, wherein the packing gland, seal, and elongate pin screen filter are all concentric to a wireline.

14. The tool of claim 11, further comprising a centralizer sleeve about the top sub, wherein the centralizer sleeve is braced against an outer shoulder of the top sub by the upper crossover, and wherein the centralizer comprises a plurality of ribs for centralizing the tool within the tubular or wellbore.

15. The tool of claim 1, wherein each rotary hub of the plurality of rotary hubs comprises a plurality of brush bristles.

16. The tool of claim 1, wherein the mandrel comprises a plurality of inlet ports at an upper end, a first sealing cup facing upwards and positioned about the outer surface of the mandrel below the plurality of inlet ports, and a second sealing cup facing downward and positioned about the outer surface of the mandrel below the first sealing cup and above the plurality of rotary hubs, wherein the first sealing cup directs fluid inwardly through the plurality of inlet ports into the central annulus of the mandrel, and wherein the second sealing cup prevents flowback of fluid ejected from the lateral bores of the plurality of rotary hubs.

17. A method of dispersing fluid within a tubular or wellbore comprising:

assembling a plurality of bushings and a plurality of rotary hubs along an outer surface of a mandrel in alternating order, such that each adjacent pair of the plurality of rotary hubs is separated by a bushing of the plurality of bushings, wherein a plurality of lateral bores on each rotary hub of the plurality of rotary hubs aligns with a plurality of lateral bores on the outer surface of the mandrel;

attaching a nose cone to a lower end of the mandrel, wherein the nose cone comprises a sleeve abutting the lowermost bushing of the plurality of bushings and secures the plurality of bushings and plurality of rotary hubs in place;

attaching an upper end of the mandrel to a wireline or tool string;

lowering the mandrel within the tubular or wellbore;

pumping fluid into a central annulus of the mandrel to pressurize the fluid;

ejecting the pressurized fluid outwardly from the plurality of lateral bores of the mandrel, wherein the pressurized fluid impacts an inner surface of the plurality of rotary hubs causing the plurality of rotary hubs to rotate and disperse the pressurized fluid laterally into the tubular or wellbore through the plurality of lateral bores of the plurality of rotary hubs.

* * * * *